US007229729B2

(12) United States Patent
Shida et al.

(10) Patent No.: US 7,229,729 B2
(45) Date of Patent: Jun. 12, 2007

(54) ELECTROPHOTOGRAPHIC PHOTORECEPTOR, PROCESS CARTRIDGE, IMAGE FORMING APPARATUS AND IMAGE FORMING METHOD

(75) Inventors: Kazuhisa Shida, Hino (JP); Masao Asano, Tokyo (JP); Hiroshi Yamazaki, Hachioji (JP); Akihiko Itami, Hachioji (JP); Tomoo Sakimura, Hino (JP)

(73) Assignee: Konica Monolta Business Technologies, Inc., Tokyo (JP)

( * ) Notice: Subject to any disclaimer, the term of this patent is extended or adjusted under 35 U.S.C. 154(b) by 132 days.

(21) Appl. No.: 10/888,730

(22) Filed: Jul. 9, 2004

(65) Prior Publication Data

US 2005/0037274 A1 Feb. 17, 2005

(30) Foreign Application Priority Data

Jul. 16, 2003 (JP) ..... 2003-197768
Jul. 18, 2003 (JP) ..... 2003-199048
Jul. 22, 2003 (JP) ..... 2003-199543

(51) Int. Cl.
*G03G 5/14* (2006.01)

(52) U.S. Cl. ..... 430/60; 430/63; 430/65; 430/120; 399/159

(58) Field of Classification Search ..... 430/60, 430/62, 63, 64, 65, 120; 399/159
See application file for complete search history.

(56) References Cited

U.S. PATENT DOCUMENTS 5,155,000 A * 10/1992 Matsumura et al. ..... 430/108.6
5,378,566 A * 1/1995 Yu ..... 430/58.05
5,430,526 A * 7/1995 Ohkubo et al. ..... 399/159
5,660,961 A * 8/1997 Yu ..... 430/65
5,688,621 A * 11/1997 Takegawa et al. ..... 430/64
5,744,271 A * 4/1998 Aizawa et al. ..... 430/59.6
6,548,218 B1 * 4/2003 Kukimoto et al. ..... 430/120
6,986,978 B2 * 1/2006 Nukada et al. ..... 430/125
2003/0118927 A1 * 6/2003 Nakamura et al. ..... 430/65

FOREIGN PATENT DOCUMENTS

JP 2000-221719 * 8/2000

OTHER PUBLICATIONS

Japanese Patent Office machine-assisted translation of JP 2000-221719 (pub. Aug. 2000).*
Grant, R., et al., ed., *Grant & Hackh's Chemcial Dictionary*, 5th edition, McGraw-Hill Book Company, NY (1987), p. 531.*
Diamond, A.S., ed., *Handbook of Imaging Materials*, Marcel Dekker, Inc., NY (1991), pp. 160-161.*
USPTO English-language translation of JP 2000-221719A (pub. Aug. 2000).*

* cited by examiner

*Primary Examiner*—Janis L. Dote
(74) *Attorney, Agent, or Firm*—Lucas & Mercanti, LLP

(57) ABSTRACT

An electrophotographic photoreceptor having an intermediate layer in which the intermediate layer contains a compound formed from a composition containing the following components X, Y and Z.

Component X: Inorganic oxide network forming compound

Component Y: Metal atom-containing organic network forming compound

Component Z: Binder network forming compound

16 Claims, 5 Drawing Sheets

ELECTROPHOTOGRAPHIC PHOTORECEPTOR, PROCESS CARTRIDGE, IMAGE FORMING APPARATUS AND IMAGE FORMING METHOD

BACKGROUND

1. Technical Field

The present invention relates to an electrophotographic photoreceptor, a process cartridge, an image forming apparatus and an image forming method to be employed in the electrophotographic image forming system, more in detail, relates to an electrophotographic photoreceptor, the process cartridge, the image the forming apparatus and the image forming method to be employed in the electrophotographic image forming system applied in the field of copy machine and printer.

2. Related Art

Organic photoreceptors have many merits such as that the materials can be selected from wide range, excellent in the suitability to the environmental and the production cost is low compared with inorganic photoreceptors such as a selenium photoreceptor and an amorphous silicone photoreceptor. Therefore, the organic photoreceptor recently becomes as the main stream of the electrophotographic photoreceptor in place of the inorganic photoreceptors.

In the image forming system according to the Carlson method, the electrophotographic photoreceptor is charged and a static latent image is formed thereon, and the a toner image is formed and the toner image is transferred onto image receiving paper and fixed to form a final image.

Besides, a digital image forming system employing a LED or a laser as the light source for imagewise exposing is rapidly spread in the image forming method of the recent electrophotographic system. For example, a technique for making an high quality electrophotographic image is disclosed, in which the imagewise exposure is given by a laser beam having a small spot area so as to form a high precise latent image with high dot latent image density, and then the latent image is developed by a fine particle toner (Japanese Patent publication Open to Public Inspection, hereinafter referred to as Japanese Patent O.P.I. Publication, No. 2001-255685).

Recently, miniaturization and high speed driving of the electrophotographic apparatus such as the digital copying machine and the printer are progressed and the photoreceptor is required at the same time to make higher the sensitivity corresponding to the high speed driving and to improve the anti-wearing ability for prolonging of the life thereof.

However, problems of the degradation of the charging ability and the stability of the sensitivity are caused when a charge generation material and a charge transfer material suitable for such the high sensitivity and the high speed driving are used. Namely, problems that the charged potential tends to be lowered and the remaining potential tends to be increase under a high temperature and high humidity condition or a low temperature and low humidity condition are caused.

The degradation in the charged potential and the stability of sensitivity causes lowering the difference between the potential at the unexposed area (VH) and that at the exposed area (VL) so as to lower the image density, and the difference between potential at the unexposed area VH and the direct current bias potential (VDC) applied to the photoreceptor and the developing sleeve is also lowered so as to tend to occur a image fault such as black spots.

A technique has been developed in which an intermediate layer is used in the organic photoreceptor to stabilize the charged potential and to solve the problems of the image defect such as black spots. For example, an organic photoreceptor is disclosed in which the intermediate layer is provided between the electroconductive substrate and the photosensitive layer; the intermediate layer is composed of a resin in which titanium oxide particles are dispersed. Furthermore, an intermediate layer containing surface treated titanium oxide is known. For example, organic photoreceptors having an intermediate layer containing titanium oxide surface-treated by iron oxide or tungsten oxide (Japanese Patent O.P.I. Publication No. 4-303846), that containing titanium oxide surface treated by an amino acid-containing coupling agent (Japanese Patent O.P.I. Publication No. 9-96916)., that containing titanium oxide surface-treated by an organic silicon compound (Japanese Patent O.P.I. Publication No. 9-258469), that containing titanium oxide surface-treated by methylhydrogenpolysiloxane (Japanese Patent O.P.I. Publication No. 8-328283) or that containing dendrite-shaped titanium oxide surface-treated by a metal oxide or an organic compound(Japanese Patent O.P.I. Publication No. 11-344826) have been proposed.

Under the serious condition such as high temperature and high humidity, however, the prevention of occurrence of the black spots is insufficient and problems such as that the raising in the remaining potential and in the potential at the exposed area caused accompanied with the repeating use so that sufficient image density cannot be obtained even when such the techniques are applied.

Moreover, it has been proposed that the crystal structure is further exactly controlled for improving the occurrence of the black spots and the raising in the remaining potential and in the potential at the exposed area accompanied with repeating use. For example, an intermediate layer containing anatase type titanium oxide pigment, hereinafter referred to as anatase type titanium oxide or anatase type titanium oxide particle, has been proposed ((Japanese Patent O.P.I. Publication No. 11-327188). The anatase type titanium oxide is lower in the volume resistance than the rutile type titanium oxide. Consequently the thickness of the intermediate layer can be thicker and the irregularity of the electroconductive substrate surface can be concealed by such the thick layer so as to easily prevent the injection of the charge from the electroconductive substrate. Besides, The dark attenuation of the charged potential is increased and fogging by the reversal development tends to increase. Such the contrary problems cannot be sufficiently solved yet by the disclosure of the patent publications.

For example, the method is well known in which the intermediate layer is formed by dispersing titanium oxide particles in polyamide resin. The polyamide resin employed in such the case, usually a copolymerized amide resin mainly constituted by a chemical structure having a small number of carbon atoms such as 6-nylon and a tri-methylized polyamide resin, has high water absorbability. The intermediate layer using such the polyamide resin tends to be high in the environment dependency. As a result of that, the charging property is easily varied under the high temperature and humidity condition and the black spots easily occur.

It is prospected that the copolymerized polyamide resin constituted by a constituting unit having large number of carbon atom between the amide bonds such as 12-nylon is suitable material for producing the photoreceptor having low environmental dependency since such the resin has low water absorbability. However, such the polyamide resin does not suit for producing the photoreceptor since the resin is insoluble in a usual organic solvent. Though examples in which the solubility of the resin is increased by methoxylization are disclosed ((Japanese Patent O.P.I. Publication Nos. 5-72787 and 6-186767), the occurrence of the black spots and the environmental memory is difficultly prevented since the water absorption of the resin is considerably increased by the methoxymethylization.

Though examples in which a compound having a Si-containing glassy network subunit, a flexible organic subunit and photo-electrical subunit (Japanese Patent O.P.I. Publication No. 11-316468), and a resin layer containing an organic polymer, a siloxane condensation product and an anti-oxidation component is applied as outer most layer (Japanese Patent O.P.I. Publication No. 2002-236382) have been reported, the application of these resins in the intermediate layer for solving the foregoing problems are not reported.

Hitherto a corona discharging device is typically employed as the charging means. However, the corona discharging device causes problems that the degradation of the organic photoreceptor, hereinafter referred to as photoreceptor, and bad influence on the human body are caused since high voltage should be applied to the corona discharging device and large amounts of ionized oxygen, ozone, moisture and a nitrogen oxide compound are generated.

Recently, application of contact charging method without the use of the corona discharging device is investigated. In concrete, a magnetic brush or an electroconductive roller as the charging means, to which voltage is applied, is contacted to the photoreceptor as the material to be charged to charge the photoreceptor surface at the designated potential. The applying voltage can be lowered and the generation amount of ozone can be reduced by the use of such contacting charge method compared with the non-contact charging method using the corona discharging device.

In the contact charging method, a charging member having a resistance of about from $10^2$ to $10^{10}$ Ω·cm is contacted with pressure to the photoreceptor while applying direct current or direct current overlapped with alternative current voltage to the charging member for providing the charge. In this charging method, the charging is started by applying voltage higher than a certain threshold value since the discharge from the charging member to the subjective member is progressed according to Paschen's law. In the contact charging method, the applying voltage is lower that in the corona charging method and the generation amount of ozone and nitrogen oxide compound is reduced.

However, the repeatedly charging to the electrophotographic photoreceptor by the contacting of the charging roller causes cracks and contamination on the photoreceptor surface. As a result of that, the charge is concentrated to the cracks and the contaminated portion so that the image defects such as dielectric breakdown and black spot are tend to occur and the spreading of the image also occurs. Such the problems are easily posed in under the serious conditions such as high temperature and high humidity and low temperature and low humidity.

It is proposed to prevent the occurrence of the dielectric breakdown and the black spot that the surface of the electroconductive substrate is anodized for raising the resistivity of the photoreceptor against leak of charge and so as to prevent the charge leak from the electroconductive substrate even when the cracks and the contamination are formed on the photoreceptor surface (Japanese Patent O.P.I. Publication No. 5-080567).

A new charging system in which the charge is directly injected into the photoreceptor has been proposed (Japanese Patent O.P.I. Publication No. 6-3921). In this method, a charge injection layer is provided on the photoreceptor surface and the charge is injected by contacting with a contacting electroconductive member such as a charging roller, a charging brush and a charging magnetic brush to which voltage is applied. The charging almost 1 by 1 with respect to the charged voltage can be performed by this charging method, with almost no discharging phenomenon. Accordingly, the method is an excellent charging method since the generation amount of ozone and $NO_x$ is considerably small and the necessary electric power is low.

An electrophotographic photoreceptor for the injection charging has be known, in which the charge injection layer is provided on the surface (mainly on the charge transfer layer) of the photoreceptor. Namely, an electrophotographic photoreceptor having the charge injection layer containing a binder resin and an electroconductive fine particle or a charge transfer material as the outermost layer is proposed (Japanese Patent O.P.I. Publication No. 2002-31911). However, when the charging through the charge injection is repeatedly performed by the directly contacting with the charging roller, cracks and contamination are formed on the charge injection layer and the charge is concentrated to the portion of the cracks and the contamination so as to tend to result the image defect such as the dielectric breakdown and the black spots and the spreading of the image is also tend to occur. These problems particularly tend to be posed under the serious conditions such as high temperature and humidity and the low temperature and humidity.

In the electrophotographic photoreceptor employing the anodized aluminum substrate, however, the properties of anodized layer is varied depending on the slight variation of the conditions of anodized treatment and that of the storage thereafter so that the above-described charge leak preventing effect is difficultly obtained, furthermore, it is observed that the interface of the anodized layer and the light-sensitive layer tends to be a charge trap site and the remaining potential is gradually increased accompanied with the prolongation of the using period.

SUMMARY

An electrophotographic photoreceptor and an image forming apparatus having the photoreceptor in which the photoreceptor contains a compound constituted by the following components X, Y and Z.

Component X: Inorganic oxide network forming compound

Component Y: Metal atom-containing organic network forming component

Component Z: Binder network forming compound

DETAIL DESCRIPTION OF THE EXEMPLARY EMBODIMENTS

Constitution of Electrophotographic Photoreceptor

Figure 1:
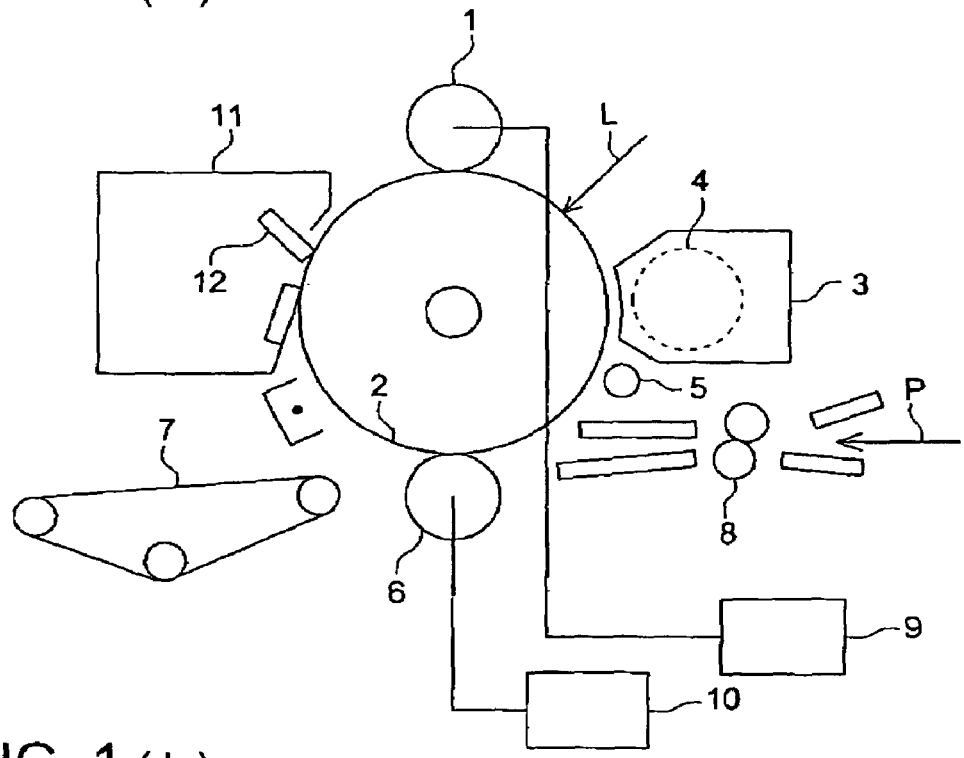
FIG. 1(*a*) shows an example of image forming apparatus utilizing charging by a charging roller, and FIG. 1(*b*) shows a cross section of the charging roller.
Figure 1:
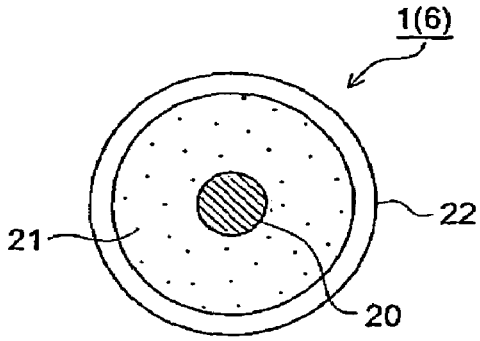

It is preferable that the electrophotographic photoreceptor has an intermediate layer and a photosensitive layer, and further has a charge injection layer and/or a protective layer according to necessity, in which the intermediate layer contains formed by a composition having the following Components X, Y and Y.

Component X: Inorganic oxide network forming compound

Component Y: Metal atom-containing organic network forming component

Component Z: Binder network forming compound

The photosensitive layer may be constituted by a charge generation layer and a charge transfer layer.

The above constitution of the electrophotographic photoreceptor can contribute to any one or the entire of the following items of 1, 2, 3-1, 3-2 and 3-3.

1. The dependency of the sensitivity and the remaining potential on the environmental conditions is reduced.

2. Image can be stably obtained even if the using conditions are suddenly changed from an environment of high temperature and high humidity to an environment of low temperature and low humidity.

3. When digital image is formed by reversal development, in the electrophotographic image, 1) occurrence of the image defects such as the black spots and the moire are prevented under various environment conditions, 2) the density of the image is high, and 3) the sharpness is high.

Moreover, the foregoing constitution of the electrophotographic photoreceptor can contribute to any one or the entire items of the foregoing.

Items 4 and 5 below tend to occur in the image forming apparatus which has a charging means by contacting a charging member onto the electrophotographic photoreceptor. The foregoing constitution can contribute any one or the entire items.

4. Occurrence of the image defects such as the black spots and the dielectric breakdown is prevented, and 5. The degradation in the electrophotographic properties (such as sensitivity and the remaining potential) is prevented so as to stably form images for a long period.

The common network forming compound in Components X, Y and Z is one capable forming a compound having a three dimensional bonding (the resin structure in the intermediate layer and/or the protective layer) by the inter reaction of each of the compound of Components X, Y and Z.

The Component X is an inorganic oxide particle having a reactive group on the surface thereof. As Component X or the inorganic oxide network forming compound, an inorganic oxide particle can be employed, which has on the surface thereof a hydroxyl group or an amino group capable of reacting with the metal atom-containing organic network forming compound of Component Y and the binder network forming compound of Z component. As such the inorganic compound, particle of oxide such as cerium oxide, chromium oxide, aluminum oxide, magnesium oxide, silicon oxide, tin oxide, zirzonium oxide, iron oxide and titanium oxide are employable.

Among the above inorganic oxide particles, titanium oxide ($TiO_2$), zinc oxide (ZnO), aluminum oxide ($Al_2O_3$) and zirconium oxide ($ZrO_2$) are preferable and titanium oxide is particularly preferred.

The inorganic fine particle having a number average primary particle diameter of from 5 to 400 nm, particularly from 10 nm to 200 nm, is preferable. The number average primary particle diameter is a value defined by the average diameter in the feret direction measured by the analysis of the image of 100 particles randomly selected from the fine particles observed by a transmission electron microscope with a magnitude of 10,000 times.

The crystal type of titanium oxide includes anatase type, rutile type, brookite type and amorphous type. Among them, anatase type titanium oxide pigment is preferable for the inorganic oxide particle.

As Component Y or the metal atom-containing organic network forming compound, a coupling agent is preferable, which can react with the reactive group such as the hydroxyl group being on the surface of the inorganic oxide particle or the binder network forming compound of Component Z. Among them, a silane coupling agent, a titanium coupling agent and an aluminum coupling agent are preferred.

For example, isopropyltriisostearoyl titanate, isopropyltris(dioctylpyrophosphate)titanate, isopropyltri(N-aminoethyl-aminoethyl)titanate, tetraoctylbis(ditridecylphosphite) titanate, tetra(2,2-diallyloxymethyl-1-butyl)bis(ditridecyl) phosphite titanate, bis(dioctylpyrophosphate)oxyacetate titanate, bis(dioctylpyrophosphate)ethylene titanate, isopropyltrioctanoyl titanate, isopropyldimethacrylisostearoyl titanate, isopropyltridodecylbenzenesulfonyl titanate, isopropylisostearoyldiacryl titanate, isopropyltri(dioctylphosphate)titanate, isopropyltriacylphenyl titanate and tetraisopropylbis(dioctylphosfie)titanate are usable as the titanium coupling agent.

As the aluminum coupling agent, for example, acetoalkoxyaluminumdiisopropylate is employable.

As the silane coupling agent, for example, vinyltrichlorosilane, vinyltris(β-methoxyethoxy)silane, vinyltriethoxysilane, vinyltrimethoxysilane, γ-methacryloxypropyltrimethoxysilane, β-(3,4-epoxycyclohexyl) ethyltrimethoxysilane, γ-glycidoxypropyltrimethoxysilane, γ-glycidoxypropylmethyldiethoxysilane, N-β-(aminoethyl)-γ-aminopropylmethyldimethoxysilane, γ-aminopropyltriethoxysilane, N-phenyl-γ-aminopropylmethoxysilane, γ-mercaptopropyltrimethoxysilane and γ-chloropropyltrimethoxysilane are employed.

It is allowed that the inorganic oxide network forming compound of Component X is previously treated by the metal atom-containing network forming compound of Component Y, and the surface treated inorganic oxide compound of Component X is reacted with the later-mentioned Component Z. In such the case, the surface treatment of the inorganic oxide network forming compound of Component X can be carried out by the following wet method.

The inorganic oxide network forming compound of Component X is added to a solution or suspension of the metal atom-containing network forming compound of Component Y in an organic solvent or water, and the resultant mixture liquid was dispersed in media for a time of from several second to about twenty four hours and subjected to a heating treatment according to necessity so as to obtain a dispersion of the inorganic oxide network forming compound of Component X cover with the metal atom-containing network forming compound of Component Y. It is also allowed that the metal atom-containing network forming compound of Component Y is added to the suspension of the inorganic oxide network forming compound of Component X in the organic solvent or water.

The amount of the metal atom-containing network forming compound of Component Y to be used for the surface treatment is preferably from 0.1 to 50 parts by weight, and more preferably from 0.1 to 40 parts by weight, to 100 parts by weight of the inorganic oxide network forming compound of Component X in the amount on the occasion of charging. When the amount is within the above range, the effects of the surface treatment can be sufficiently obtained and the rectification effect and the dispersing state of the inorganic oxide network forming compound of Component X in the intermediate layer are improved. It is resulted that the electrophotographic properties are improved, raising of the remaining potential is prevented and lowering of the charge potential is inhibited.

As Component Z or the binder network forming compound, a compound, oligomer or segment is employed which has a reactive group with the inorganic particle of Component X and the coupling agent of Component Y and is capable of forming resin functioning as a binder component. Component Z can be a reactive organic silicon compound. Component 2 can be a reactive segment. The reactive segment can be a low polymerization degree vinyl type resin. Component Z can be a combination of a reactive organic silicon compound and a reactive segment.

As the Component Z or the binder network forming compound, reactive organic silicon compounds capable of forming a siloxane condensate (a condensate having a structure in which plural siloxane bonds are three-dimensionally linked) represented by the following Formula 1 are preferred.

$$R_nSi(Z)_{4-n} \qquad \text{Formula 1}$$

In the formula, R is an organic group in which a carbon atom is directly bonded to the silicon atom in the formula, Z is a hydroxyl group or a hydrolyzable group, and n is an integer of from 0 to 3.

In the above Formula 1, Z is a hydrolyzable group such as a methoxy group, an ethoxy group, a methylethylketoxyme group, a diethylamino group, an acetoxy group, a propenoxy group, a propoxy group, a butoxy group and a methoxyethoxy group. The organic group represented by R in which a carbon atom is directly bonded to the silicon atom is, for example, an alkyl group such as a methyl group, an ethyl group, a propyl group and a butyl group; an aryl group such as a phenyl group, a tolyl group, a naphthyl group and a biphenyl group; an epoxy-containing group such as a γ-glycidoxypropyl group and a β-(3,4-epoxycyclohexyl) ethyl group; a (meth)acryloyl-containing group such as a γ-acryloxypropyl group and a γ-methacryloxypropyl group; a hydroxyl-containing group such as a γ-hydroxypropyl group and a 2,3-dihydroxypropyloxypropyl group; a vinyl-containing group such as a vinyl group and a propenyl group; a mercapto-containing group such as a γ-mercaptopropyl group; an amino-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and perfluorooctylethyl group; a nitro- and a cyano-substituted alkyl group.

When n is 2 or 3, the organic groups each bonded with the same silicon atom may be the same as or different from each other.

When two or more kinds of reactive organic silicon compound represented by Formula 1 are employed on the occasion of producing the siloxane condensate component, R in the each reactive silicon compounds may be the same of different.

Concrete examples of the reactive organic silicon compound represented by the following Formula 1 include the followings.

Examples of the compound in which n is 0 are tetrachlorosilane, diethoxydichlorosilane, tetramethoxysilane, phenoxytrichlorosilane, tetraacetoxysilane, tetraethoxysilane, tetraallyloxysilane, tetrapropoxysilane, tetraisopropoxysilane, tetrakis(2-methoxyethoxy)silane, tetrabutoxysilane, tetraphenoxysilane, tetrakis(2-ethylbutoxy)silane and tetrakis(2-ethylhexyloxy)silane.

Examples of the compound in which n is 1 are trichlorosilane, are chrolomethyltrichlorosilane, methyltrichlorosilane, 1,2-dibromoethyltrichlorbsilane, vinyltrichlorosilane, 1,2-dichloroethyltrichlorosilane, 1-chloroethyltrichlorosilane. 2-chloroethyltrichlorosilane, ethyltrichlorosilane, 3,3,3-trifluoropropyltrichlorosilane, 2-cyanoethyltrichlorosilane, allyltrichlorosilane, 3-bromopropyltrichlorosilane, chrolomethylmethoxysilane, 3-chloropropyltrichlorosilane, n-propyltrichlorosilane, ethoxymethyldichlorosilane, dimethoxymethylchlorosilane, trimethoxysilane, 3-cyanopropyltrichlorosilane, n-butyltrichlorosilane, isobutyltrichlorosilane, chloromethyltriethoxysilane, methylmethoxysilane, mercaptomethyltrimethoxysilane, pentyltrichlorosilane, trimethoxyvinylsilane, ethyltrimethoxysilane, 3,3,4,4,5,5,6,6,6-nonafluorohexyltrichlorosilane, 4-chlorophenylchlorosilane, phenyltrichlorosilane, cyclohexyltrichlorosilane, tris(2-chloroethoxy)silane, 3,3,3-trifluoropropyltrimethoxysilane, 2-cyanoethyltrimethoxysilane, triethoxychlorosilane, 3-chloropropyltrimethoxysilane, triethoxysilane, 3-mercaptopropyltrimethoxysilane, 3-aminopropyltrimethoxysilane, 2-aminoethylaminomethyltrimethoxysilane, benzyltrichlorosilane, p-tolyltrichlorosilane, 6-trichlorosilyl-2-norbornane, 2-trichlorosilylnorbornane, methyltriacetoxysilane, heptyltrichlorosilane, chloromethyltriethoxysilane, butyltrimethoxysilane, methyltriethoxysilane, methyltris(2-aminoethoxy)silane, β-phenethyltrichlorosilane, triacetoxyvinylsilane, 2-(4-cyclohexylethyl)trichlorosilane, ethyltriacetoxysilane, 3-trifluoroacetoxypropyltriaceoxysilane, octyltrichlorosilane, triethoxyvinylsilane, ethyltriethoxysilane, 3-(2-aminoethylaminopropyl)trimethoxysilane, chloromethylphenylethyltrichlorosilane, 2-phenylpropyltrichlorosilane, 4-chlorophenyltrimethoxysilane, phenyltrimethoxsilane, nonyltrichlorosilane, 2-cyanoethyltriethoxysilane, allyltriethoxysilane, 3-allylthiopropyltrimethoxysilane, 3-glycidoxypropyltrimethoxsilane, 3-bromopropyltriethoxysilane, 3-chloropropyltriethoxysilane, 3-allylaminoproyltrimethoxysilane, propyltriethoxysilane, hexyltrimethoxysilane, 3-aminopropyltriethoxysilane, methyltriisopropenoxysilane, 3-methacryloxypropyltrimethoxysilane, decyltrichlorosilane, bis(methylethylketoxime)methoxymethylsilane, 3-morpholinopropyltrimethoxysilane, 3-piperazinopropyltrimethoxysilane, methyltripropxysilane, methyltris(2-methoxyethoxysilane), 2-(2-amonpethylthioethyl)triethoxysilane, 3-[2-(2-aminoethylaminoethylamino)propyl] triethoxysilane, tris(1-metylvinyloxy)vinylsilane, 2-(3,4-epoxycyclohexylethyl)trimethoxysilane, triisopropoxyvinylsilane, tris(2-methoxyethoxy)vinylsilane, diisopropoxyethylmethylketoxime methylsilane, 3-piperidinopropyltrimethox silane, pentyltriethoxysilane, 4-chlorophenyltriethoxysilane, phenyltriethoxysilane, bis(ethylmethylketoxime)methylisopropoxysilane, bis (ethylmethylketoxime)-2-methoxyethoxymethylsilane, 3-(2-methylpiperidinopropyl)trimethoxysilane, 3-cyclohexylaminopropyltrimethoxysilane, O,O'-diethyl-S-(2-triethoxysilylethyl)dithiophosphate, benzyltriethoxysilane, 6-triethoxysilyl-2-norbornane, 3-benzylaminopropyltrimethoxysilane, methyltris(ethylmethylketoxime)silane, bis(ethylmethyketoxime)mutoxymethylsilane, methyltris(N,N-dimethylaminoxy)silane, tetradecyltrichlorosilane, octyltriethoxysilane, phenyltris(2-methoxyethoxy)silane, 3-(vinylbenzylaminopropyl)trimethoxysilane, N-(3-troethoxysilylpropyl)-p-nitrobenzamide, 3-(vinylbenzylaminopropyl)triethoxysilane, octadecyltrichlorosilane, dodecyltriethoxysilane, docosyltrichlorosilane, domethyloctadecyl-3-trimethoxysilylpropylammonium chloride and 1,2-bis(methyldichlorosilyl)ethane.

Examples of the compound in which n is 2 are chloromethylmethyldichlorosilane, dimethyldichlorosilane, ethyldichlorosilane, methylvinyldichlorosilane, ethylmethyldichlorosilane, dimethoxymethylsilane, dimethoxydimethylsilane, divinyldichlorosilane, methyl-3,3,3-trifluoropropyldichlorosilane, allylmethyldichlorosilane, 3-chloropropylmethyldichlorosilane, diethyldichlorosilane, 3-cyanopropylmethyldichlorosilane, butylmethyldichlorosilane, bis(2-chloroethoxy)methylsilane, diethoxymethylsilane, phenyldichlorosilane, diallyldichlorosilane, dimethoxymethyl-3,3,3-trifluoropropylsilane, methylpentyldichlorosilane, 3-chloropropyldimethoxymethylsilane, chloromethyldiethoxysilane, dimethoxy-3-mercatopropylmethylsilane, 3,3,4,4,5,5,6,6,6-nonafluorohexylmethyldichlorosilane, methylphenyldichlorosilane, diacetoxymethylvinylsilane, cyclohexylmethyldichlorosilane, hexylmethyldichlorosilane, diethoxymethylvinylsilane, hexylmethyldichlorosilane, diethoxymethylvinylsilane, phenylvinyldichlorosilane, 6-methyldichlorosilyl-2-norbornane, 2-methyldichlorosilylnorbornane, 3-methacryloxypropylmethyldichlorosilane, diethoxydivinylsilane, heptylmethyldichlorosilane, dibutyldichlorosilane, diethoxydiethylsilane, dimethylpropoxysilane, 3-aminopropyldiethoxymethylsilane, 3-(2-aminoethylaminopropyl)dimethoxymethylsilane, allylphenyldichlorosilane, 3-chloropropylphenyldichlorosilane, methyl-β-pnenethyldichlorosilane, domethoxymethylphenylsilane, 2-(4-cyclohexenylethyl)methyldichlorosilane, methyloctyldichlorosilane, diethoxyethylmethylketoximemethylsilane, 2-(2-aminoethylthioethyl)diethoxymethylsilane, O,O'-diethyl-S-(2-trimethylsilylethyl)dithiophosphate, O,O'-diethyl-S-(2-trimethoxysilylethyl)dithiophosphate, t-butylphenyldichlorosilane, 3-methacryloxypropyldimethoxymethylsilane, 3-(3-cyanopropylthiopropyl)dimethoxymethylsilane, 3-(2-acetoxyethylthiopropyl)dimethoxymethylsilane, dimethoxymethyl-2-piperidinoethylsilane, dimethoxymethyl-3-piperazinopropylsilane, dibutoxudimethylsilane, dimethoxy-3-(2-ethoxyethylthiopropyl)methylsilane, 3-dimethylaminopropyldiethoxymethylsilane, diethyl-2-trimethylsilylmethylthioethylphosphite, diethoxmethylphenylsilane, decylmethyldichlorosilane, bis(ethylmethylketoxime)ethoxymethylsilane, diethoxy-3-glycidoxypropylmethylsilane, 3-(3-acetoxypropylthio)propyldimethoxymethylsilane, dimethoxymethyl-3-piperidinopropylsilane, dipropoxyethylmethylketoximemethylsilane, diphenyldichlorosilane, diphenyldifluorosilane, diphenylsilanediol, dihexyldichlorosilane, bis(ethylmethylketoxime)methylpropoxysilane, dimethoxymethyl-3-(4-methylpiperidinopropyl)silane, dodecylmethyldichlorosilane, dimethoxydiphenylsilane, dimethoxyphenyl-2-piperidinoethoxysilane, dimethoxymethyl-3-(3-phenoxypropylthiopropyl)silane, diacetoxydiphenylsilane, diethoxydiphenylsilane, diethoxydodecylmethylsilane, methyloctadecyldichlorosilane, diphenylmethoxy-2-piperidinoethoxysilane, docosylmethyldichlorosilane and diethoxymethylocatdecylsilane.

Regarding the reactive organic silicon compounds to be used as the raw materials of the siloxane condensate having the three dimensional crosslinked structure, the polymer forming reaction of the reactive silicon compound is inhibited when n in (4-n) or the number of the hydrolysable group directly bonded to the silicon atom is 3. The polymer forming reaction is easily progressed when n is 0, 1 or 2. Particularly, the crosslinking reaction can be highly progressed when n is 1 or 0. Therefore, the storage ability and the hardness of the coated layer can be controlled by controlling the value of n.

Another example of the binder network forming compound of Component Z is a reactive segment which can be reacted with the inorganic oxide network forming compound of Component X and the metal atom-containing organic network forming compound of Component Y to form the resin structure. The segment is a polymer with low polymerization degree to be used for forming the final resin structure of the intermediate layer.

An example of the segment is a vinyl type resin segment having a silyl group formed by coexistence of a chain polymerizable monomer and a polymerizable silane compound capable of polymerizing with the chain polymerizable monomer, which can be reacted with the inorganic oxide network forming compound of Component X and the metal atom-containing organic network forming compound of Component Y to form the resin structure.

A silyl group-containing vinyl resin having a chain polymerized component introduced with a silyl group can be formed by progressing polymerization in the presence of the chain polymerizable monomer together with the polymerizable silane compound represented by the following Formula 2, and the chain polymer component is made reactable by the introduced silyl group with the inorganic oxide network forming composition of Component X and the metal atom-containing organic network forming compound of Component Y. Particularly, when the silyl-containing vinyl resin is employed together with the reactive organic silicon compound represented by Formula 1 capable of forming the siloxane condensate, the binder component formed by the two Components Z constitutes the resin structure in which the organic segment (the segment containing a carbon atom in the chain structure) of the vinyl resin and the inorganic segment (the segment having a chain structure of silicon and oxygen). Such the resin is excellent in the adhesiveness with the substrate and the dispersing ability for the inorganic oxide particle, and the intermediate layer excellent in the properties of the repeating use and the black spot prevention can be formed by the resin. In the photoreceptor having the intermediate layer comprised of the binder resin formed by the two kinds of Component Z, the remaining potential and the charged potential are stable even when the thickness of the intermediate layer is increased, and the surface of the electroconductive substrate can be sufficiently covered and the dielectric breakdown and the black spots are sufficiently prevented even if the roughness of the electroconductive substrate surface is within the range of several μm.

Formula 2

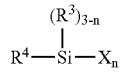

In Formula 2, $R^3$ is a hydrogen atom, an alkyl group having carbon atoms of from 1 to 10 or an aralkyl group having carbon atoms from 1 to 10, $R^4$ is an organic group having a polymerizable double bonds X is a halogen atom, an alkoxy group, an acyloxy group, an aminoxy group or a phenoxy group, and n is integer of from 1 to 3.

The polymerizable silane compound of Formula 2 is not specifically limited as long as the silane compound has a silyl group, particularly a hydrolyzable silyl group, and is capable of polymerizing with the later-mentioned various kinds of chain polymerizable monomer. Examples of the polymerizable silane compound are $CH_2{=}CHSi(CH_3)(OCH_3)_2$, $CH_2{=}CHSi(OCH_3)_3$, $CH_2{=}CHSi(CH_3)Cl_2$, $CH_2{=}CHSiCl_3$, $CH_2{=}CHCOO(CH_2)_2Si(CH_3)(OCH_3)_2$, $CH_2{=}CHCOO(CH_2)_2Si(OCH_3)_3$, $CH_2{=}CHCOO(CH_2)_3Si(CH_3)(OCH_3)_2$, $CH_2{=}CHCOO(CH_2)_3Si(OCH_3)_3$, $CH_2{=}CHCOO(CH_2)_2Si(CH_3)Cl_2$, $CH_2{=}CHCOO(CH_2)_2SiCl_3$, $CH_2{=}CHCOO(CH_2)_3Si(CH_3)Cl_2$, $CH_2{=}CHCOO(CH_2)_3SiCl_3$, $CH_2{=}C(CH_3)COO(CH_2)_2Si(CH_3)(OCH_3)_2$, $CH_2{=}C(CH_3)COO(CH_2)_2Si(OCH_3)_3$, $CH_2{=}C(CH_3)COO(CH_2)_3Si(CH_3)(OCH_3)_2$, $CH_2{=}C(CH_3)COO(CH_2)_3Si(OCH_3)_3$, $CH_2{=}C(CH_3)COO(CH_2)_2Si(CH_3)Cl_2$, $CH_2{=}C(CH_3)COO(CH_2)_2SiCl_3$, $CH_2{=}C(CH_3)COO(CH_2)_3Si(OCH_3)_3$, $CH_2{=}C(CH_3)COO(CH_2)_3Si(CH_3)C_{12}$, $CH_2{=}C(CH_3)COO(CH_2)_3SiCl_3$,

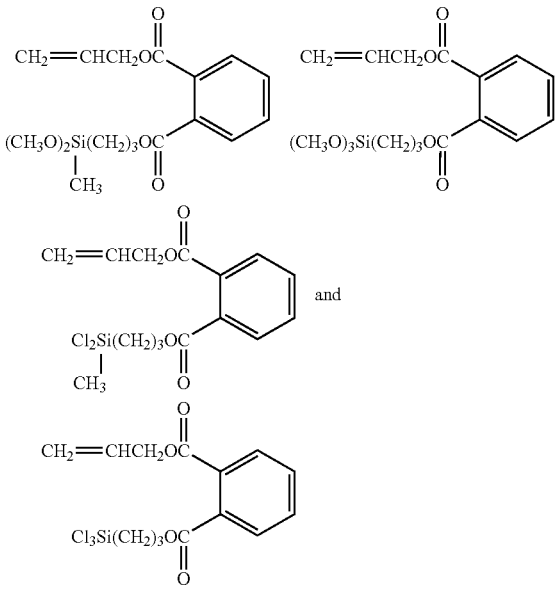

These polymerizable silane compounds may be employed singly or in combination.

As the chain polymerizable monomer to form the vinyl type resin segment together with the polymerizable silane compound represented by Formula 2, for example, one or more selected from the group of the followings are preferably employed: (meth)acrylates such as methyl(meth)acrylate, ethyl(meth)acrylate, butyl(meth)acrylate, 2-ethylhexyl (meth)acrylate and cyclohexyl(meth)acrylate; carboxylic acids such as acrylic acid, itaconic acid and fumalic acid, and acid anhydrides such as maleic anhydride; epoxy compounds such as glycidyl(meth)acrylate; amino compounds such as diethylamino(meth)acrylate and aminoethyl vinyl ether; amide compound such as (meth)acrylamide, itaconic diamide, α-ethylacrylamide, crotonamide, fumalic diamide, N-butoxymethyl(meth)acrylamide; acrylonirile; styrene; α-methylstyrene; vinyl chloride; vinyl acetate; and vinyl propionate. Chain polymerizable vinyl monomers having a hydroxyl group such as 2-hydroxyethyl(meth)acrylate, 2-hydroxylpropyl(meth)acrylate, 2-hydroxyvinyl ether and N-methylolacrylamide are also can be employed.

As the binder network forming compound of Component Z, an anti-oxidation subunit forming compound may be used as the chain polymerizable vinyl monomer capable of forming the vinyl type resin segment.

The anti-oxidation subunit is a group having resistivity against oxidation or reduction caused by an active gas such as ozone and $NO_x$ or exposure to light such as ultraviolet rays.

Addition of the anti-oxidation ability to the binder resin can be attained by taking in the anti-oxidation subunit such as a hindered amine or a hindered phenol to a part of the resin structure as the subunit (partial structure).

A vinyl type resin segment having the anti-oxidation subunit and the silyl group is formed by the polymerization reaction employing the oxidation subunit forming compound together with the polymerizable silane compound represented by Formula 2 and the chain polymerizable vinyl monomer for forming the vinyl type resin segment. The vinyl type resin segment can be chemically bonded through the silyl group of the vinyl type resin segment to the inorganic oxide network forming compound of Component X, the metal atom-containing organic network forming compound of Component Y or the siloxane condensate.

The hindered amine group is a group or its derivative having steric hindrance near the N atom of the amino group of an amino compound. A branched alkyl group or a group having three or more carbon atoms are preferred as the group having the steric hindrance.

The hindered phenol group is a group or its derivative having the steric hindrance at the ortho-position with respect to the hydroxyl group of phenol, in which the hydroxyl group may be modified to an alkoxy group. A branched alkyl group or a group having three or more carbon atoms are preferred as the group having the steric hindrance.

For introducing the hindered amine group or the hindered phenol group into the vinyl type resin segment as the partial structure thereof, the hindered amine compound (monomer) or the hindered phenol compound (monomer) each having a polymerizable unsaturated group containing carbon-carbon unsaturated bond as the anti-oxidation subunit forming compound is made coexist with the polymerizable silane condensate compound of Formula 2 and the chain polymerizable vinyl monomer, and the mixed composition is polymerized. Thus the hindered amine group or the hindered phenol group can be introduced into the vinyl type resin segment.

As the hindered amine compound having the polymerizable unsaturated group, amino compounds with steric hindrance which has a polymerizable unsaturated group are preferred, and piperidine compounds with steric hindrance are particularly preferable among them, which has a polymerizable unsaturated group, hereinafter referred to as piperidine monomer. Compounds represented by the following Formula A can be cited as the typical examples of the piperidine compound.

Formula A

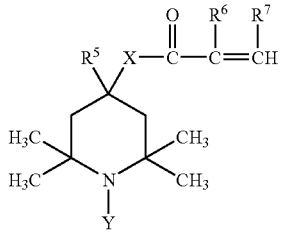

In Formula A, $R^5$ is a hydrogen atom or a cyano group, $R^6$ and $R^7$ are each a hydrogen atom, a methyl group or an ethyl group, which may be the same of different, X is an oxygen atom or an imino group or a polymerizable unsaturated group represented by Formula B.

Formula B

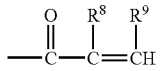

In Formula B, $R^8$ and $R^9$ are each a hydrogen atom, a methyl group or an ethyl group, which may be the same of different.

The hydrogen atom in the imino group of X of Formula A may be substituted or unsubstituted. Examples of the alkyl group having from 1 to 18 carbon atoms represented by Y in Formula A are straight chain and branched chain alkyl groups such as a methyl group, an ethyl group, an n-propyl group, an isopropyl group, an n-butyl group, an isobutyl group, a sec-butyl group, a t-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group and an n-octadecyl group.

Preferable compound among the piperidine compounds of Formula A are 4-(meth)acryloyloxy-2,2,6,6-tetramethylpiperidine, 4-(meth)acryloylamino-2,2,6,6-tetramethylpiperidine, 4-(meth)acryloyloxy-1,2,2,6,6-pentamethylpiridine, 4-(meth)acryloylamino-1,2,2,6,6-pentamethylpiridine, 4-cyano-4-(meth)acryloyloxy-2,2,6,6-tetramethylpiperidine, 4-cyano-4-(meth)acryloylamino-2,2,6,6-tetramethylpiperidine, 4-cyano-4-(meth)acryloyloxy-1,2,2,6,6-pentamethylpiperidine, 4-cyano-4-(meth)acryloylamino-1,2,2,6,6-pentamethylpiperidine, 1-(meth)acryloyl-4-(meth)acryloyloxy-2,2,6,6-tetramethylpiperidine. 1-(meth)acryloyl-4-(meth)acryloylamino-2,2,6,6-tetramethylpiperidine, 1-(meth)acryloyl-4-cyano-4-(meth)acryloyloxy-2,2,6,6-tetramethylpiperidine. 1-(meth)acryloyl-4-cyano-4-(meth)acryloylamino-2,2,6,6-tetramethylpiperidine, 4-crotonoyloxy-2,2,6,6-tetramethylpiperidine, 4-crotonoylamino-2,2,6,6-tetramethylpiperidine, 4-crotonoyloxy-1,2,2,6,6-pentamethylpiperidine, 4-crotonoylamino-1,2,2,6,6-pentamethylpiperidine, 4-cyano-4-crotonoyloxy-2,2,6,6-tetramethylpiperidine, 4-cyano-4-crotonoylamino-2,2,6,6-tetramethylpiperidine, 1-crotonoyl-4-crotonoyloxy-2,2,6,6-tetramethylpiperidine, 1-crotonoyl-4-crotonoylamino-2,2,6,6-tetramethylpiperidine, 1-crotonoyl-4-cyano-4-crotonoyloxy-2,2,6,6-tetramethylpiperidine and 1-crotonoyl-4-cyano-4-crotonoylamino-2,2,6,6-tetramethylpiperidine. Among them, 4-(meth)acryloyloxy-2,2,6,6-tetramethylpiperidine and 4-(meth)acryloyloxy-1,2,2,6,6-pentamethylpiperidine are particularly preferred.

Hindered phenol compounds having a polymerizable unsaturated group are preferred as the hindered phenol compound having a polymerizable unsaturated group, for example, the following compounds are employable: 2-t-butyl-6-(3-t-butyl-2-hydroxy-5-methylbenzyl)-4-methylphenyl acrylate, 2-(3,5-di-t-butyl-4-hydroxyphenyl)ethyl acrylate, 2-(3,5-di-s-propyl-4-hydroxyphenyl)ethyl acrylate, 2-(3,5-di-t-octyl-4-hydroxyphenyl)ethyl acrylate, 2-(3-t-butyl-5-(3-t-butyl-2-hydroxy-5-methylbenzyl-4-hydroxyphenyl)ethyl acrylate, 2-t-butyl-6-(3-t-butyl-2-hydroxy-5-methylbenzyl)-4-methylphenyl (meth)acrylate, 2-(3,5-di-t-butyl-4-hydroxyphenyl)ethyl (meth)acrylate, 2-(3,5-di-s-propyl-4-hydroxyphenyl)ethyl (meth)acrylate, 2-(3,5-di-t-octyl-4-hydroxyphenyl)ethyl (meth)acrylate, 2-(3-t-butyl-5-(3-t-butyl-2-hydroxy-5-methylbenzyl)-4-hydroxyphenyl)ethyl (meth)acrylate, vinyl 3,5-di-t-butyl-4-hydroxyphenylpropionate, vinyl 3,5-di-t-octyl-4-hydroxyphenylpropionate, isopropenyl 3,5-di-t-butyl-4-hydroxyphenylpropionate and isopropenyl 3,5-di-t-octyl-4-hydroxyphenylpropionate.

Examples of compound other than the hindered amine type or hindered phenol type anti-oxidation subunit forming compound (compound having the polymerizable unsaturated group) include salicylic acid compounds such as phenylsalicylic acid (meth)acrylate and t-butylphenylsalicylic acid (meth)acrylate; benzophenone compounds such as 2-(meth)acryloyloxy-4-methoxybenzophenone, 2-(meth)acryloyloxy-2'-hydroxy-4-methoxybenzophenone, 2,2'-di(meth)acryloyloxy-4-methoxybenzophenone, 2,2'-di(meth)acryloyloxy-4,4'-dimethoxybenzophenone, 2-(meth)acryloyloxy-4-methoxy-2'-carboxybenzophenone, 2-hydroxy-4-[3-(meth)acryloyloxy-2-hydroxypropoxy]benzophenone and 2,2'-dihydroxy-4-[3-(meth)acryloyloxy-2-hydroxypropoxy]benzophenone; benzotriazole compounds such as 2-[2'(meth)acryloyloxy-5'-methylphenyl]benzotriazole, 2-[2'-(meth)acryloyloxy-5'-t-octylphenyl]benzotriazole and 2-[2'-(meth)acryloyloxy-3',5'-di-t-butylphenyl]benzotriazole; and 2-ethylhexyl-2-cyano-3.3-diphenyl(meth)acrylate, 1,3-bis(4-benzoyl-3-hydroxyphenoxy)-2-propyl (meth)acrylate and ethyl-2-cyano-3,3-diphenyl(meth)acrylate. In the invention, the anti-oxidation forming compounds may be used singly or in combination of two or more kinds. "Having the hindered amine group or the hindered phenol group" means that the compound has at least on of the hindered amine group and the hindered phenol group, and the compound may has both of them.

Synthesizing examples of the vinyl type resin segment which has the hindered amine group or the hindered phenol group and modified by silyl group.

(Synthesizing Example of Vinyl Type Resin Segment A Solution: Solution of Vinyl Type Resin Segment A Having Hindered Amine Group and Silyl-Modified)

In a reaction vessel having a circulation cooling device and a stirrer, 25 parts of γ-methacryloyloxypropyltrimethoxysilane, one part of 4-methacryloyl-1,2,2,6,6-pentamethylpiperidine, 80 parts of methyl methacrylate, 15 parts of 2-ethylhexyl methacrylate, 29 parts of n-butyl acrylate, 150 parts of 2-propanol, 50 parts of 2-butanone and 25 parts of methanol were charged and the mixture was heated by 80° C. while stirring, and a solution of 4 parts of azobisisovaleronitrile in 10 parts of xylene was dropped spending for 30 minutes. After that the reaction was continued for 5 hours. Thus a solution with a solid ingredient concentration of 40% of Vinyl Type Resin Segment A having the hindered amine group and the silyl group as the side chain was obtained.

(Synthesizing Example of Vinyl Type Resin Segment B Solution: Solution of Vinyl Type Resin Segment B having Hindered Phenol Group and Silyl-Modified)

In a reaction vessel having a circulation cooling device and a stirrer, 20 parts of γ-methacryloyloxypropyltrimethoxysilane, 2 parts of 2-t-butyl-6-(3-t-butyl-2-hydroxy-5-methylbenzyl)-4-methylphenylacrylate, 70 parts of methyl methacrylate, 40 parts of n-butyl acrylate, 5 parts of acrylic acid, 13 parts of 2-hydroxymethyl methacrylate, 1 part of 1,1,1-trimethylaminemethacrylimide, 150 parts of 2-propanol, 50 parts of 2-butanone and 25 parts of methanol were charged and the mixture was heated by 80° C. while stirring, and a solution of 4 parts of azobisisovaleronitrile in 10 parts of xylene was dropped spending for 30 minutes. After that the reaction was continued for 5 hours. Thus a solution with a solid ingredient concentration of 40% of Vinyl Type Resin Segment B having the hindered phenol group and the silyl group as the side chain was obtained.

(Synthesizing Example of Vinyl Type Resin Segment C Solution: Solution of Silyl-Modified Vinyl Type Resin Segment C)

In a reaction vessel having a circulation cooling device and a stirrer, 25 parts of γ-methacryloyloxypropyltrimethoxysilane, 80 parts of methyl methacrylate, 15 parts of 2-hydroxymethyl methacrylate, 30 parts of n-butyl acrylate, 150 parts of 2-propanol, 50 parts of 2-butanone and 25 parts of methanol were charged and the mixture was heated by 80° C. while stirring, and a solution of 4 parts of azobisisovaleronitrile in 10 parts of xylene was dropped spending for 30 minutes. After that the reaction was continued for 5 hours. Thus a solution with a solid ingredient concentration of 40% of Vinyl Type Resin Segment B having the silyl group.

As is shown in the above synthesizing examples A and B, the vinyl type resin segment having the hindered amine group or hindered phenol group as the side chain and the silyl group can be synthesized by polymerizing the hindered amine compound or the hindered phenol compound each having the polymerizable unsaturated group, the polymerizable silane compound and the chain polymerizable vinyl monomer under the coexist thereof.

Though the polymerization degree of the vinyl type resin segment having the silyl group is not specifically limited, a polymerization degree of from 10 to 500 is desirable.

The intermediate layer having the resin structure according to the invention can be formed by forming the siloxane condensate component with the vinyl type resin segments A, B or C. The siloxane condensate is formed through the silyl group of the vinyl type resin segment having the silyl group by using the vinyl type resin segment having the silyl group and the reactive organic silicon compound. Though the formation of siloxane condensate may be carried out on the occasion of the formation of the intermediate layer, it is also allowed that the siloxane condensate is previously formed on the terminal of the silyl group in the intermediate layer coating liquid and then the intermediate layer is formed.

The compound constituted by Components X, Y and Z is formed by chemical bonding of Components X, Y and Z with each other in the intermediate layer.

The weight ratio of Components X, Y and Z constituting the above compound is preferably from 0.001 to 0.5 of Component Y and from 0.25 to 4 of Component Z to 1 of Component X. When the weight ratio of X is with in the above ranges, the remaining potential is difficultly increased in the course of repeating of image formation and the image density by the reversal development can be easily held. Moreover, the coating state of the charge generation layer on the intermediate layer is improved and the uniformity of the layer can be enhanced. The electrophotographic properties (properties such as charging, sensitivity and remaining potential) in the course of the repeating use can be improved by making the weight ratio of Component Z to within the above range.

The thickness of the intermediate layer is preferably from 0.2 to 22 μm, and more preferably from 4 to 20 μm. The thickness can be made within the range of from 1 to 18 μm. The dielectric breakdown and the black spots can be prevented and the good electrophotographic properties (such as the properties of charging, sensitivity and remaining potential) can be obtained by making the layer thickness to within such the range.

The protective layer is described below.

The protective layer may be a layer containing the siloxanepolycarbonate or crosslinked siloxane resin as the binder, the layer preferably contains a compound formed from the composition containing the foregoing Component Z and the later-mentioned Component T.

The charge transfer subunit forming compound of Component T is a compound which has drift mobility of electron or positive hole and a reactive group capable of chemically reacting with the binder network forming compound of Component Z, and thus formed compound is capable of constituting the partial structure of the binder resin of the surface layer.

The charge transfer subunit forming compound of Component T can put the charge transfer subunit (a group having charge transfer function) into the resin structure such as the siloxane condensate by reacting with the reactive organic silicon compound of the binder network forming compound of Component Z. The charge transfer subunit forming compound is a charge transferable compound which has a reactive group capable of chemically bonding with the reactive organic silicon compound or the silyl group of the side chain of the organic polymer. The charge transfer subunit forming compound is described below.

As the charge transfer subunit forming compound, charge transfer compounds having a hydroxyl group, a mercapto group, an amine group or a silyl group can be cited.

The charge transfer compounds having the hydroxyl group are represented by the following Formula 3.

$$X—(R_7—OH)_m \qquad \text{Formula 3}$$

In the formula, X is a charge transfer subunit, $R_7$ is a simple bond, a substituted or unsubstituted alkylene group or arylene group, and m is an integer of from 1 to 5.

The typical ones are as follows. For example, a triarylamine compounds are preferably usable, each of which has a triarylamine structure such as triphenylamine, as the charge transfer subunit, and has the hydroxyl group through the carbon atom constituting X or the alkyl group or arylene group extended from X.

The charge transfer compound having a mercapto group is represented by the following Formula 4.

$$X—(R_8—SH)_m \qquad \text{Formula 4}$$

In the above, X is a charge transfer subunit, $R_8$ is a simple bond, a substituted or unsubstituted alkylene group or arylene group, and m is an integer of from 1 to 5.

The charge transfer compound having an amine group is represented by the following Formula 5.

$$X—(R_9—NR_{10}H)_m \qquad \text{Formula 5}$$

In the above, X is a charge transfer subunit, $R_9$ is a simple bond, a substituted or unsubstituted alkylene group or a substituted or unsubstituted arylene group, $R_{10}$ is a hydrogen atom, a substituted or unsubstituted alkyl group or a substituted or unsubstituted aryl group, and m is an integer of from 1 to 5.

Among the charge transfer compounds having the amino group, when the compound is a primary amine compound (—$NH_2$), the two hydrogen atoms may be reacted with the organic silicon compound to linked with the siloxane structure. In the case of secondary amine (—$NHR_{10}$), the one hydrogen atom is reacted with the organic silicon compound, and $R_{10}$ may be a group remaining as a branch, a group capable of occurring crosslinking reaction, or a residue of a compound containing a charge transfer moiety.

The charge transfer compounds each having the silyl group are represented by the following Formula 6.

$$X—(—R_1—Si(R_{11})_{3-a}(R_{12})_a)_n \qquad \text{Formula 6}$$

In the formula, X is a charge transfer subunit, $R_{11}$ is a hydrogen atom, a substituted or unsubstituted alkyl or aryl group, $R_{12}$ is a hydrolyzable group or a hydroxyl group, $R_1$ is a substituted or unsubstituted alkylene group, a is an integer of from 1 to 3, and n is an integer.

Typical examples of compounds represented by Formulas 3 through 6 are listed below.

(B-1)

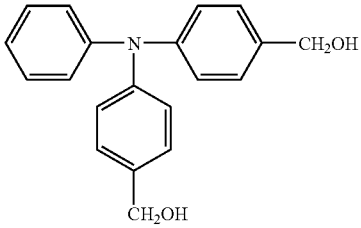

(B-2)

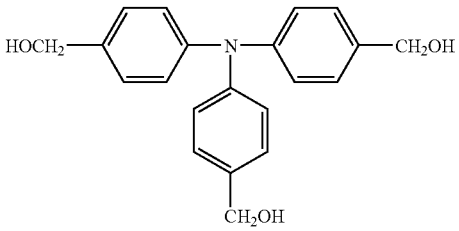

(B-3)

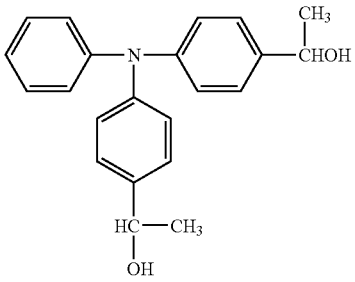

-continued (B-4)

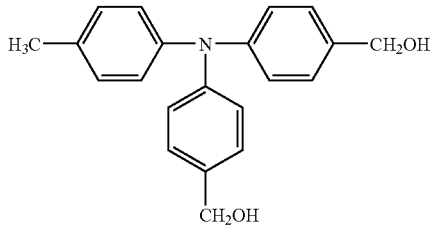

(B-5)

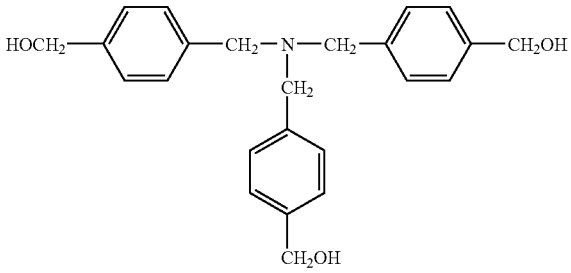

(B-6)

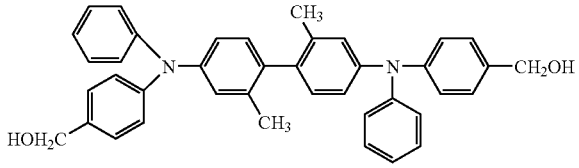

(B-7)

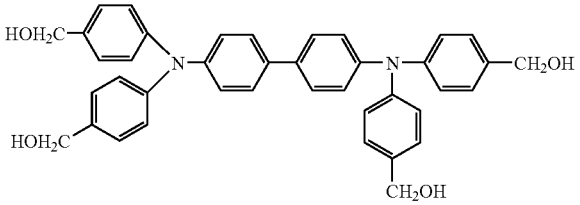

(B-8)

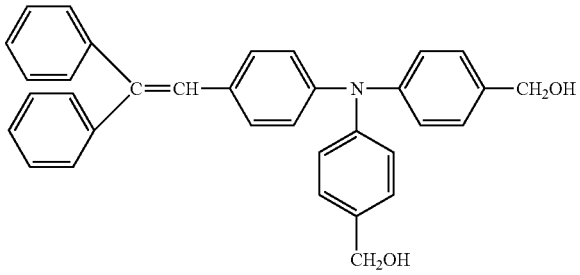

(B-9)

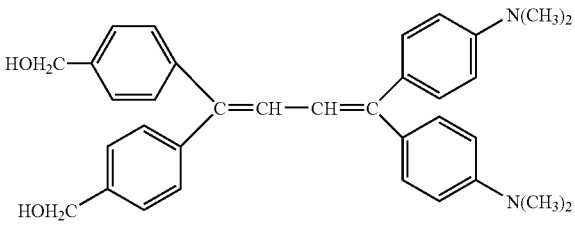

-continued (B-10)

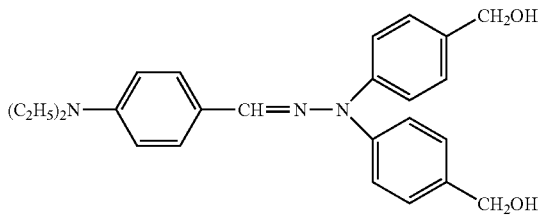

(B-11)

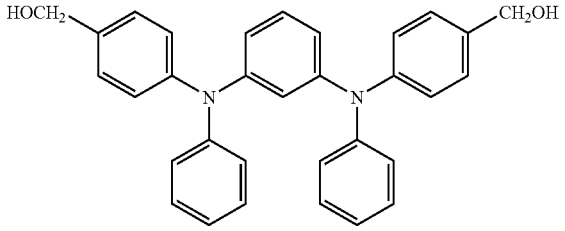

(B-12)

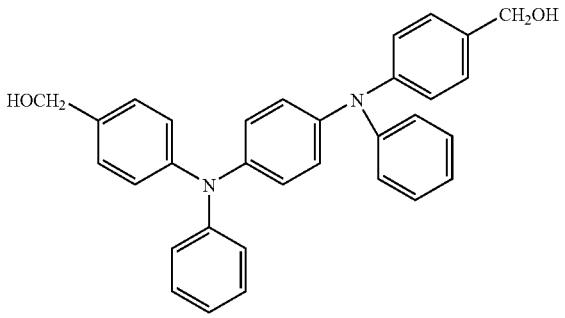

(B-13)

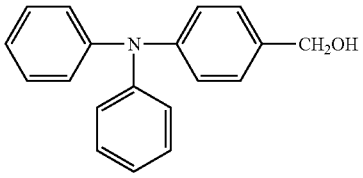

(B-14)

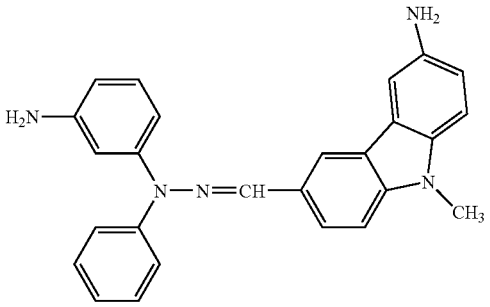

-continued (B-15)

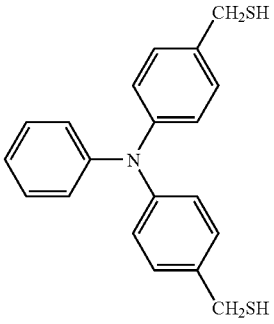

Si-1

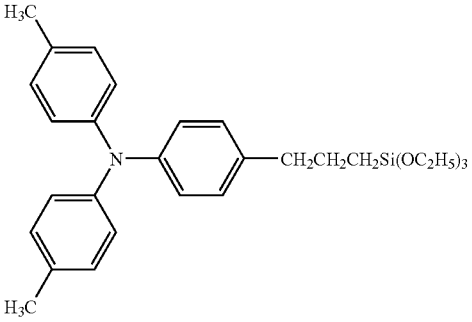

Si-2

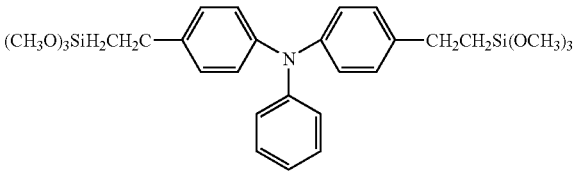

Si-3

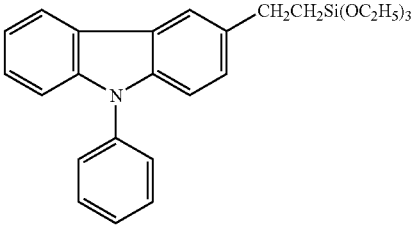

The charge transfer subunit forming compounds each having plural reactive groups in the molecule thereof is preferred. Such the charge transfer subunit forming compound is raised in the reactivity with the organic silicon compound and provides good charge transferring property to the surface layer according to the invention.

The charge transfer subunit is, for example, the chemical structure component corresponding to the charge transfer subunit X in Formulas 3 through 6. Concrete examples of the chemical structure of the charge transfer subunit X of the positive hole transfer type CTM are groups having the chemical structure of oxazole, oxydiazole, thiazole, triazole, imidazole, imidazolone, imidazoline, bisimidazoline, styryl, hydrazone, benzidine, pyrazoline, stilbene compound, amine, oxazolone, benzothiazole, benzimidazole, quinazoline, benzofuran, acridine, phenadine, aminostilbene, poly-N-vinylcarbazole, poly-1-vinylpyrene and poly-9-vinylanthrathene.

Example of the electron transfer type CTM are ones having the following chemical structure: succinic anhydride, maleic anhydride, pyromeritic anhydride, meritic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chrolanyl, bromanyl, benzoquinone, naphthoquinone, diphenoquinone, tropoquinone, anthraquinone, 1-chloroanthraquinone, dinitroanthraquinone.4-nitrobenzophenone, 4,4'-dinitrobenzophenone, 4-nitrobenzalmalonodinitrile, α-cyano-β-(p-cyanophenyl)-2-(p-chlorophenyl)ethylene, 2,7-nitroflureone, 2,4,7-trinitrofluorenone, 2,4,5,7-tetranitrofluorenone, 9-fluorenylidenedicyanomethylenemalononitrile, polynitro-9-fluoronylidenedicyanomethylenemalonodinitrile, picric acid, o-nitrobenzoic acid, p-nitrobenzoic acid, 3,5-dinitrobenzoic acid, pentafluorobenzoic acid, 5-nitrosalisylic acid, 3,5-dinitroalicylic acid, phthalic acid and meritic acid.

The molecular weight of the charge transfer subunit forming compound is preferably from 100 to 700. The surface layer which small increasing of the remaining potential and good photographic properties and is excellent in the cleaning property can be obtained the use of the charge transfer subunit forming compound having a molecular weight of not more than 700. The charge transfer subunit forming compound having a molecular weight of from 100 to 450 is more preferable.

Though the charge transfer subunit X is described in the formula as a mono-valent group, the charge transfer subunit forming compound may be bonded as a di- or more-valent crosslinking group when the charge transfer subunit forming compound has two or more reactive functional groups or as only a pendant group.

When the protective layer contains the compound (resin) formed by the reaction of the binder network forming compound of Component Z with the charge transfer subunit forming compound, it is preferable that these compounds are bonded with each other by chemical bonding and the protective layer is entirely has the crosslinked structure.

The ratio of the Component T to whole weight of Component Z in the composition of the protective layer containing Compositions Z and T is preferably from 1:0.01 to 1:2. The electrophotographic properties (properties of charging, sensitivity and remaining potential) in the course of repeating use and the layer strength are improved by making the ratio of Component T to within such the range.

When the reactive organic silicon compound and the reactive segment are employed with together as the Component Z of the protective layer, the ratio of the reactive organic silicon compound is preferably from 0.25 to 4 to 1 of the reactive segment. When the ratio of the reactive organic silicon compound is within the above range, the layer strength, the charging property, and the dependency of the sensitivity on the temperature and humidity are improved. The adhesiveness to the light-sensitive layer is also improved.

It is desirable that the thickness of the protective layer is from 0.1 to 10 μm, and preferably from 0.3 to 5 μm.

Metal oxide particles may be added to the above-described protective layer within the range in which the effects of the invention is not disturbed. The anti-wearing ability of the protective layer according to the invention can be further raised, and the stability of the cleaning ability of the toner and the turning over of the cleaning blade can be also improved by the addition of the metal oxide particles.

The primary particle diameter of the metal oxide particles is preferably from 5 nm to 500 nm. Such the metal oxide particles are usually produced by a liquid phase method and are obtained in a form of colloidal particles. Examples of the metal atom include Si, Ti, Al, Cr, Zr, Sn, Fe, Mg, Mn, Ni and Cu.

The metal oxide particle preferably has a compound group reactable with the organic silicon compound on the surface thereof. The reactive compound group is, for example, a hydroxyl group and an amino group. By the use of the metal oxide particles each having such the reactive group, a composite protective layer is formed in which the siloxane condensate component and the metal oxide particle surface are chemically bonded, so that the protective layer is formed, which is highly resistive to the frictional wear and shows good electrophotographic properties. The adding amount is preferably from 0.1 to 30% by weight of the whole amount of the protective layer from the viewpoint of the cleaning property and the image forming ability under high humidity condition.

Moreover, organic fine particles may be added to the protective layer. The surface energy can be reduced so as to raising the cleaning ability by the addition of the organic fine particles. Examples of the organic fine particles include those of fluorinated resins, silicone resins, acryl resins and olefin resins, and the fluorinated resins such as polytetrafluoroethylene and poly(vinylidene fluoride, and the olefin resins such as polyethylene and polypropylene are particularly suitable. The organic fine particle may be employed singly or in combination of two or more kinds.

It is desirable that the size of the organic fine particle is from 0.01 to 1.0 μm, and preferably from 0.01 to 0.3 μm, in terms of the volume average diameter of the largest length of the projection image of the particle. The adding amount of the organic fine particle is preferably from 0.1 to 30% by weight of the total weight of the protective layer from the viewpoint of the sensitivity of the photoreceptor, prevention of increasing in the remaining potential on the photoreceptor in the course of repeating use and the prevention of fogging.

The Component Z in the intermediate layer and that in the protective layer may be the same or different from each other. The kind of the reactive organic silicon compound in the intermediate layer and that in the protective layer may be different from each other and the reactive segment is also may be the same of different.

The production methods of the intermediate layer and the protective layer are described below.

The intermediate layer may be prevented by any method as long as the forgoing intermediate layer can be formed. The production method of the intermediate layer according to the invention is described below.

The intermediate layer can be formed by coating a coating liquid containing Components X, Y and Z and then hardening the coating liquid coated on the electroconductive substrate.

In the compound formed by hardening the composition containing Components X, Y and Z, Components X, Y and Z are chemically bonded with together through the reactive groups of each of the components so as to form the intermediate layer excellent in the charging and the photosensitive properties and the rectification ability, by which the injection of charge from the electroconductive substrate is sufficiently prevented, and the dielectric breakdown and the black spots are prevented.

The protective layer may be formed by any method.

The preferable protective layer can be formed by coating a coating liquid of a composition containing Components Z and T and then hardening the coated layer.

In the compound formed by hardening the composition containing Components Z and T, Components Z and T are chemically bonded with together through the reactive group of each of the components. The electrophotographic photoreceptor can be formed by such the compound, which is excellent in the prevention of the dielectric breakdown, and the charging and the photosensitive properties and has high durability.

It is preferable to add a metal chelate compound into the composition (coating liquid) or the preparation course of the coating liquid of the intermediate layer or that of the protective layer. The metal chelate compound is a chelate compound of a metal selected from the group of zirconium, titanium and aluminum, hereinafter referred to as metal chelate compound (III). It is considered that the metal chelate compound (III) accelerates the hydrolysis and/or the partial condensation reaction so as to accelerate the formation of the three component—(Components X, Y and Z) or two component-condensate (Components z and T).

Examples of the metal chelate compound (III) include compounds represented by Formula 7, 8 or 9 and the partial hydrolysis products thereof.

$$Zr(OR_5)_p(R_6COCHCOR_7)_{4-p} \quad \text{Formula 7}$$

$$Ti(OR_5)_q(R_6COCHCOR_7)_{4-q} \quad \text{Formula 8}$$

$$Al(OR_5)_r(R_6COCHCOR_7)_{3-r} \quad \text{Formula 9}$$

In Formulas 7 through 9, $R_5$ and $R_6$ are each independently a mono-valent hydrocarbon group having from 1 to 6 such as an ethyl group, an n-propyl group, an i-propyl group, an n-butyl group, a sec-butyl group, a t-butyl group, an n-pentyl group, an n-hexyl group, a cyclohexyl group and a phenyl group; and $R_7$ is a mono-valent hydrocarbon group the same as the $R_5$ and $R_6$, and an alkoxy group having from 1 to 16 carbon atoms such as a methoxy group, an ethoxy group, an n-propoxy group, an i-propoxy group, an n-butoxy group, a sec-butoxy group, a t-butoxy group, a lauryl group and a stearoyloxy group. p and q are each an integer of from 0 to 3 and r is an integer of from 0 to 2.

Concrete examples of the metal chelate compound (III) are zirconium chelate compounds such as zirconium tri-n-butoxy.ethylacetoacetate, zirconium tri-n-butoxy.bis(ethylacetoacetate), zirconium tri-n-butoxy.tris(ethylacetoacetate), zirconium tetrakis(n-propylacetoacetate), zirconium tetrakis(acetylacetoacetate) and zirconium tetrakis(ethylacetoacetate); titaniumchelate compounds such as titanium di-i-propoxy.bis(acetylacetate) and titanium di-i-propoxy.bis(acetylacetone); and aluminum chelate compounds such as aluminum di-i-propoxy.ethylacetoacetate, aluminum di-i-propoxy.acetylacetonate, aluminum i-propoxy.bis(ethylacetoacetate), aluminum i-propoxy.bis(acetylacetonate), aluminum tris(ethylacetoacetate), aluminum tris(ethylacetate), aluminum tris(acetoacetonate) and aluminum monoacetylacetonate.bis(ethylacetoacetate. Among the above compounds, zirconium tri-n-butoxy.ethylacetoacetate, titanium di-i-propoxy.bis(acetylacetonate), aluminum di-i-propoxy.ethylacetoacetate and aluminum tris(ethylacetoacetate) are preferable. These metal chelate compounds (III) may be employed singly or in combination of two ore more kinds.

The adding amount of the metal chelate compound (III) is from 0.01 to 20% and preferably from 0.5 to 20% by weight of the solid ingredient of the coating liquid containing Components X, Y or Z or that of the coating liquid containing Components Z and T (the solid ingredient of the coating liquid is the ingredient remaining after the coating liquid is dried). When the adding amount is within the above range, the three-dimensional structure of the resin is easily formed and satisfactory pot-life of the coating liquid can be obtained.

The hardening of the coating liquid after coating is preferably carried out for a period of from 30 minutes to 6 hours at a temperature of from 60 to 150° C., even though the hardening condition is depended on the reacting ability of Component X, Y and Z or Components Z and T.

The presence of an organic solvent is preferably for accelerate the hardening reaction. Alcohols, aromatic hydrocarbon compounds, ethers, ketones and esters are preferable for the organic solvent. The using amount of the organic solvent is not limited by the reactive organic silicon compound and is controlled according to the using purpose.

As the solvent for accelerating the hardening reaction, ones capable of uniformly dissolving the reactive organic silicon compound or the vinyl type resin segment are preferably employed. Alcohols, aromatic hydrocarbon compounds, ethers and esters are used as such the solvent, and the solvents exemplified in the followings are preferred.

Alcohols having from 1 to 4 carbon atoms such as methanol, ethanol, n-propanol, iso-propanol, n-butanol, iso-butanol, sec butanol and tert-butanol are preferably used as the alcohol type solvent.

As the non-alcoholic solvent, ketone type solvents such as ethyl methyl ketone, methyl isopropyl ketone and methyl isobutyl ketone are preferably used.

A hardening accelerating agent may be added to the intermediate layer and the protective layer according to necessity.

Alkali metal salts such as that of naphthenic acid, octinic acid, nitrous acid, sulfurous acid, aluminic acid and carbonic acid; alkaline compounds such as sodium hydroxide and potassium hydroxide; acidic compounds such as alkyltitanic acid, phosphoric acid, p-toluenesulfonic acid and phthalic acid; amine compounds such as ethylenediamine, diethylenetriamine, triethylenetetramine, tetraethylenepentamine, piperidine, piperazine, methaphenylenediamine, ethanolamine, triethylamine, various kinds of modified amine usually used as the hardening agent of epoxy resin, γ-aminopropyltriethoxysilane, γ-(2-aminoethyl)-aminopropyltrimethoxysilane, γ-(2-aminoethyl) aminopropylmethyldimethoxsilane and γ-anilinopropyltrimethoxysilane; carboxylic acid type organic tin compound such as $(C_4H_9)_2Sn(OCOC_{11}H_{23})_2$, $(C_4H_9)_2Sn(OCOCH{=}CHCOOCH_3)_2$, $(C_4H_9)_2Sn(OCOCH{=}CHCOOC_4H_9)_2$, $(C_8H_{17})_2Sn(OCOC_{11}H_{23})_2$, $(C_8H_{17})_2Sn(OCOCH{=}CHCOOCH_3)_2$, $(C_8H_{17})_2Sn(OCOCH{=}CHCOOC_4H_9)_2$, $(C_8H_{17})_2Sn(OCOCH{=}CHCOOC_8H_{17})_2$ and $Sn(OCOCC_8H_{17})_2$; and reaction products of organic tin oxide with ester compounds such as ethylsilicate, ethylsilicate 40, dimethyl amleate, diethyl maleate and dioctyl phthalate are used as the hardening accelerating agent.

The adding amount of the hardening accelerating agent to the intermediate layer or the protective layer is from 0.1 to 20 parts, and preferably from 0.5 to 100, by weight to 100 parts by weight of the solid ingredient of the coating liquid (the solid ingredient is the ingredient remaining after drying of the coating liquid). When the amount of the hardening accelerating agent is too small, there is possibility that the strength of the layer is lowered. When the amount is excessive, the pot-life of the coating liquid is degraded.

An organic solvent may be employed to control the solid ingredient and the viscosity of the coating liquid of the intermediate layer or the protective layer. For such the organic solvent, alcohols, aromatic hydrocarbons, ethers, ketones and esters are preferably employed. As the alcohols, for example, mono- or di-valent alcohols are usable. Concrete examples of the alcohol include methanol, ethanol, n-propyl alcohol, iso-propyl alcohol, n-butyl alcohol, sec-butyl alcohol, t-butyl alcohol, n-hexyl alcohol, n-octyl alcohol, ethylene glycol, diethylene glycol, triethylene glycol, ethylene glycol monomethyl ether, ethylene glycol monoethyl ether, ethylene glycol mono-n-propyl ether, ethylene glycol mono-n-butyl ether, ethylene glycol acetate monomethyl ether and ethylene glycol acetate monoethyl ether are usable. Among them mono-valent saturated aliphatic alcohols having from 1 to 8 carbon atoms are preferable. The concrete examples of the aromatic hydrocarbon are benzene, toluene and xylene. The concrete examples of the ether are tetrahydrofuran and dioxane. The concrete examples of the ester are ethyl acetate, n-propyl acetate, n-butyl acetate and propylene carbonate. These organic solvents may be employed singly or in a combination of two or more kinds. There is no specific limitation on the adding method of the organic solvent and the solvent may be added on an optional step of the preparation and/or after the preparation of the surface protective layer coating liquid.

The intermediate layer and the protective layer are preferably a substantially insulation layer. The volume resistance of the insulation layer is not less than $1\times10^8$. The volume resistance of the intermediate layer and the protective layer is preferably from $1\times10^8$ to $10^{15}$ Ω·cm, more preferably form $1\times10^9$ to $10^{14}$ Ω·cm, and further preferably from $2\times10^9$ to $10^{13}$ Ω·cm. The volume resistance can be measured as follows.

Measuring condition: According to JIS C2318-1975

Measuring apparatus: Hiresta IP manufactured by Mitsubishi Yuka Co., Ltd.

Measuring condition: Measuring probe HRS

Applying voltage: 500 V

Measuring environment: 30±2° C. and 80±5% RH

Suitable results from the viewpoint of the charge blocking ability of the intermediate layer, prevention of the black spots, the potential maintenance of the electrophotographic photoreceptor and the prevention of the increasing of the remaining potential during the repeating image formation can be easily obtained by making the volume resistance to within the above range.

The fact that the compound formed from the composition containing Components X, Y and Z has the three dimensional bonding structure (the resin structure of the intermediate layer or the protective layer)by the chemical reaction of Components X, Y and Z with together, can be verified by the solubility of the composition containing Component X, Y and Z in the solvent of the coating liquid of the intermediate layer or the protective layer and thermodynamic verification such as the disappear of the glass transition point (Tg).

The layer structure of the electrophotographic photoreceptor, particularly the organic photoreceptor, is described bellow.

The organic photoreceptor is an electrophotographic photoreceptor in which at least one of the charge generation function and the charge transfer function is charged with an organic compound, and entirely includes the known organic electrophotographic photoreceptors such as ones constituted by known organic charge generation materials or charge transfer materials and ones in which the charge generation function and the charge transfer function are charged with a polymer complex.

The constitution of the organic photoreceptor is described below.

Electroconductive Substrate

Both of a sheet-shaped and a cylinder-shaped electroconductive substrate may be employed for the photoreceptor, and the cylindrical electroconductive substrate is preferable for designing a compact image forming apparatus.

The cylindrical substrate is a cylindrical substrate capable of endlessly forming images by the rotation, and a substrate having a straightness of not more than 0.1 mm and a fluctuation width of not more than 0.1 mm is preferred. When the straightness and the fluctuation width are without such the range, satisfactory image formation difficultly carried out.

A metal drum such as aluminum, nickel, a plastic drum vapor deposited with aluminum, tin oxide or indium oxide, and paper and plastic drum coated with an electroconductive material can be employed for the electroconductive material. The electroconductive preferably has a specific resistance of not more than $10^3$ Ωcm at room temperature.

One having a sealing treated anodized layer on the surface thereof may be employed as the electroconductive substrate. The anodizing treatment is usually carried out in an acidic bath such as chromic acid, sulfuric acid, oxalic acid, phosphoric acid boric acid and sulfamic acid, and the treatment in the sulfuric acid bath brings the most preferable results. When the treatment is carried out in the sulfuric acid bath, a sulfuric acid concentration of is from 100 to 200 g/liter, an aluminum ion concentration of from 1 to 10 g/liter, a liquid temperature of approximately 20° C. and a applying voltage of approximately 20 V are preferable, but the conditions are not limited to the above-mentioned. The average thickness the anodized layer is usually not more than 20 μm, and particularly preferably not more than 10 μm.

Intermediate Layer

The foregoing intermediate layer having the barrier function is provided between the electroconductive substrate and the photosensitive layer.

Photosensitive Layer

Though the mono-layer photoreceptor in which the single layer has both of the charge generation function and the charge transfer function may be used, the constitution is preferable in which the functions of the photosensitive layer is separated into the charge generation layer (CGL) and the charge transfer layer (CTL). The increasing of the remaining potential accompanied with the repeating use can be controlled by the function separating constitution, and other photographic properties can be also easily controlled. In the case of the negatively charged photoreceptor, it is preferable that the charge generation layer (CGL) is provided on the intermediate layer and the charge transfer layer is provided on the charge generation layer. In the case of the positively charged photoreceptor, the order of the layers is reversed in the negatively charged photoreceptor. The most preferable constitution of the photoreceptor is the negatively charged constitution having the function separated structure.

The photosensitive layer constitution of the function separated negatively charged photoreceptor is described below.

Charge Generation Layer

A charge generating material is contained in the charge generation layer. A binder resin and another additives may be further contained.

Known charge generation materials (CGM) can be used as the charge generation material. For example, phthalocyanine pigments, azo pigments, perylene pigments and azulenium pigments are employable. Among them, CGM capable of minimizing the increasing of the remaining potential accompanied with the repeating use is ones each having a crystal structure capable of taking a stable aggregation structure among the plural molecules thereof. In concrete, the phthalocyanine pigments and perylene pigments are cited as the CGM. For example, CGM such as titanyl phthalocyanine showing the maximum peak of Bragg angle 2θ at 27.2° and benzimidazole perylene showing the maximum peak of Bragg angle 2θ at 12.4° of with respect to Cu-Kα ray are almost not degraded accompanied with repeating use and the increasing of the remaining potential can be reduced.

When a binder is employed in the charge generation layer as the dispersing medium of CGM, formal resins, butyral resins, silicone resins silicone-modified butyral resins and phenoxy resins are most preferably employed even though another know resins may be used. The ratio of the charge generation material to the binder resin is preferably 20 to 600 parts by weight to 100 parts by weight of the binder resin. The increasing of the remaining potential accompanied with the repeating use can be minimized by the use of such the resins. The thickness of the charge generation layer is preferably from 0.01 μm to 2 μm.

Charge Transfer Layer

In the charge transfer layer, a charge transfer material (CTM) and a binder resin for dispersing CTM and forming a layer. An additive such as antioxidant may be contained in the charge transfer layer according to necessity.

Known charge transfer materials can be used as the charge transfer material (CTM). For example, triphenylamine derivatives, hydrazone compounds, styryl compounds, benzidine compounds and butadiene compounds can be used. Among them, CTM capable of minimizing the increasing of the remaining potential accompanied with repeating use is ones having a high mobility and the difference of ionizing potential between that of CGM used in combination is not more than 0.5 (eV), and preferably not more than 0.30 (eV).

The ionizing potential of CGM and CTM is measured by a surface analyzing apparatus AC-1 (manufactured by Riken Keiki Co., Ltd.).

Examples of the resin employable in the charge transfer layer (CTL) are polystyrene, acryl resins, methacryl resins, vinyl chloride resins, vinyl acetate resins, poly(vinyl butyral) resins, epoxy resins, polyurethane resins, phenol resins, polyester resins, alkyd resins, polycarbonate resins, silicone resins, melamine resins, and copolymer resins containing two or more of the repeating unit of the above listed resins. Other than such the insulating resins, organic semiconductive polymers such as poly-N-vinylcarbazole can be used.

The most preferable binder resin for CTL is the polycarbonate resin. The polycarbonate resins are most preferable since the polycarbonate resins improve the dispersing and the electrophotographic properties of CTM. The ratio of the charge transfer material to the binder resin is from 10 to 200 parts by weight to 100 parts by weight of the binder resin.

It is preferable that an antioxidant is contained in the charge transfer layer. The antioxidant is typically a substance capable of preventing or inhibiting the action of oxygen to the auto-oxidizable substance existing in/on the electrophotographic photoreceptor under the condition of lighting, heating or discharging.

The thickness of the charge transfer layer is preferably from 5 to 40 μm, and more preferably from 8 to 30 μm. When the total thickness of the charge transfer layer in less than 5 μm, the charged potential tends to be insufficient, and when the thickness exceeds 40 μm, the suitability to the high speed processing is lowered and the image density and the sharpness tend to be degraded. The most preferable thickness of the transfer layer is from 16 to 25 μm by which sufficient high speed suitability and high quality of image can be obtained.

Charge Injection Layer

The electrophotographic photoreceptor may has a charge injection layer provided on the charge transfer layer. The charge injection layer can be basically constituted by a binder resin in which electroconductive fine particles are dispersed.

Resins the same as those employed in the charge transfer layer are usable for the binder resin of the charge injection layer.

As the electroconductive fine particle of the charge injection layer, anionic, cationic and nonionic organic electrolytes such as fatty acid salts, higher alcohols, sulfuric esters, fatty acid amines, quaternary ammonium salts, alkylpridium salts, polyoxyethylenealkyl ethers, polyoxyethylenealkyl esters, sorbitanealkyl esters and imidazoline derivatives; metals such as Au, Ag, Cu, Ni and Al; metal oxides such as ZnO, $TiO_2$, $SnO_2$, $In_2O_3$, $Sb_2O_3$-containing $SnO_2$ and $In_2O_3$-containing $SnO_2$; metal fluorides such as $MgF_2$, $CaF_2$, $BiF_2$, $AlF_2$, $SnF_2$, $SnF_4$ and $TiF_4$; organic titanium compounds such as tetraisopropyl titanate, tetranormalbutyl titanate, titanium acetylacetonate and ethyl titaniumlactate; and mixtures of them are employable.

In the charge injection layer, the charge transfer material may be contained. The lowering of the sensitivity accompanied with the repeating use and the increasing of the remaining potential are also prevented by the presence of the charge transfer layer. It is preferable to add a compound having the anti-oxidation ability into the charge injection layer.

The suitable thickness of the charge injection layer is from 0.3 to 10 μm and is preferably from 1 to 5 μm.

The volume resistance of the charge injection layer is preferably from $10^{10}$ to $10^{15}$ Ω·cm, and particularly preferably from $10^{10}$ to $10^{14}$ Ω·cm. The amount of the electroconductive fine particles is preferably as small as possible within the range in which the resistance and the remaining potential are acceptable since the strength of the layer is lowered accompanied with the increasing of the amount of the electroconductive fine particles.

It is preferable to make the contact angle of the photoreceptor surface to water to not less than 90°, and more preferably not less than 95°, by adding fluorinated resin particles into the charge injection layer. The occurrence of filming by the toner or paper powder which causes the dielectric breakdown and the image defects can be prevented by increasing the contact angle and lowering the surface energy. The fluorinated resin particle is a particle of resin containing a fluorine atom, for example, one or more of ethylene tetrafluoride resin, ethylene trifluorochloride resin, ethylene-propylene hexafluoride resin, vinyl fluoride resin, vinylidene fluoride resin, ethylene difluorodichloride resin and a copolymer of them are preferably selected. The ethylene tetrafluoride resin and the vinylidene fluoride resin are particularly preferred. Though the molecular weight and the particle diameter of the fluorinated resin particle can be optionally selected without any limitation, one having a volume average particle diameter of from 0.05 to 5 μm is preferable.

The volume average diameter of the fluorinated resin particle is measured by a laser diffraction/scattering particle size distribution measuring apparatus LA-700, manufactured by Horiba Seisakusho Co., Ltd. Regarding the surface contact angle of the photoreceptor, the contact angle to water is measured by a contact angle meter CA-DT-A, manufactured by Kyowa Kaimen Kagaku Co., Ltd., under a condition of 20° C. and 50% RH.

Examples of the solvent or the dispersing medium to be employed for forming the layers such as the intermediate layer, the charge generation layer and the charge transfer layer include n-butyl amine, diethyl amine, ethylenediamine, iso-propanolamine, triethylenediamine, N,N-dimethylformamide, acetone, methyl ethyl ketone, methyl isopropyl ketone, cyclohexanone, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxoran, dioxane, methanol, ethanol, butanol, iso-propanol, ethyl acetate, butyl acetate, dimethylsulfoxide and methyl cellosolve. Though the invention is not limited to them, dichloromethane, 1,2-dichloroethane and methyl ethyl ketone are preferable. These solvent may be employed singly or in a form of mixture of two or more kinds of them.

The coating liquids of each layers is preferably filtered by a filter such as a metal filter and a membrane filter before the coating process to remove a foreign material or an aggregate in the coating liquid. It is preferable that the filter for the filtration is optionally selected from filters such as pleats type HDC, depth type Profile and semidepth type Profilestar, each manufactured by Nihon Paul Co., Ltd., according to the properties of the coating liquid.

The protective layer, also referred to as the surface layer, is basically provided on the photosensitive layer to prevent the frictional wearing, damage and another defect of the photosensitive layer.

Though coating methods such as an immersing coating, a spray coating method and a circular coating amount controlling type coating can be applied for producing the electrophotographic photoreceptor, the use of the spray coating or the circular coating amount controlling coating (typically a circular slide hopper coating) is preferred for inhibiting the dissolution of the lower layer as small as possible by the coating of the upper layer and for attaining the uniform coating. The circular coating amount controlling type coating is most preferable for coating the protective layer. The circular coating amount controlling method is described in detail in, for example, Japanese Patent O.P.I. Publication No. 58-189061.

In the above-mentioned, the preferable layer structure is described, but the structure other than the above is allowed.

FIG. 1 shows an example of the image forming apparatus utilizing the charging by the charging roller. In this image forming apparatus, the photoreceptor is charged by the charging roller contacting to the photoreceptor drum as the charging means for forming the static latent image (the charging process), and a transfer roller is employed as the transfer electrode (a transfer means) for transfer the toner to the image receiving paper (the transfer process). In the apparatus, the contact charging system is employed in which the transfer roller is directly or through the image receiving paper contacted to the photoreceptor drum for avoiding the generation of ozone, and the static latent image is developed by a non-contact development.

In FIG. 1(*a*), the static latent image is formed on a photoreceptor drum 2, which is charged by a charging roller 1, by imagewise exposure by a laser (imagewise exposing process). The static latent image is developed to a toner image by a developing sleeve 4 as the developer carrier of a developing device (developing means) 3 which is arranged near the photoreceptor drum 2. And then the charge of the photoreceptor drum 2 is removed by a charge removing lamp 5, and the toner image is transferred onto the image receiving paper P conveyed from a paper supplying cassette by a conveying roller 8, in this course charge having the reversal polarity to that of the toner is provided to the image receiving paper by a transferring roller 6 and the toner is transferred to the image receiving paper by the static electricity force of the reversal polarity charge. The image receiving paper P after receiving the toner is separated form the photoreceptor drum 2 and conveyed to a fixing device by a conveying belt 7, and the toner image is transferred onto the image receiving paper P by a heating roller and a pressing roller (fixing process).

Bias voltage composed of DC and AC is applied to the charging roller 1 (and the transferring roller 6) from a power source 9 (10) so that the charging to the photoreceptor drum 2 and that to the toner image receiving paper P is carried out with extremely small amount of ozone generation. The voltage is preferably DC bias of from ±300 to 1000V overlapped with AC bias of from 100 Hz to 10 kHz and 200 to 3500 V(p-p).

The charging roller 1 and the transferring roller 2 are pressed to the photoreceptor drum 2 and rotated following the photoreceptor drum or by forcibly driving.

The contacting pressure to the photoreceptor drum 2 is from 10 to 100 g/cm and the rotating rate of the roller is fro 1 to 8 times of the circumference speed of the photoreceptor drum 2.

As is shown in FIG. 1(*b*), the charging roller 1 (and the transferring roller 6) is composed of a center metal shaft 20 and a layer of rubber or a rubber sponge of chloroprene rubber, urethane rubber or silicone rubber 21 provided around the center shaft, and preferably a protective layer 22 composed of a parting fluorinated resin or silicone resin having a thickness of from 0.01 to 1 μm is provided as the outermost layer.

After the image transfer, the photoreceptor drum is cleaned by contacting with a cleaning blade 12 of a cleaning device (cleaning means) 11 to be prepared for the next image formation.

In the electrophotographic image forming apparatus, the constituting elements such as the photoreceptor, the charging means and the developing means may be combined into an unit as a processing cartridge capable of freely installed to or released from the main body of the apparatus. Moreover, at least one of the exposing means, the developing means, transferring of separating device and the cleaning means may be combined into an unit to form a processing cartridge as a single unit capable of freely installed to or released from the apparatus using a guiding means such as a guiding rail.

In FIG. 1, though the roller charging device are employed for both of the charging device and the transferring electrode, a transferring means other than the transferring roller may be used for the transferring electrode.

The charging means is described bellow.

In FIG. 1, the charging is carried out by contacting the charging member (hereinafter referred to as the charging means using the contact-charging member) to the photoreceptor. As the charging member, various kinds of charging member such as a magnetic brush, a charging roller and a charging blade can be employed, among them the charging roller and the magnetic brush are most preferably applied as the charging member. The charging roller and the magnetic brush are preferable by which uniform charging is easily attained. The charging roller and the magnetic brush are described bellow.

The photoreceptor (image carrier) can be charged by contacting the charging roller constituted by an electroconductive elastic member to the photoreceptor (image carrier) and applying voltage to the charging roller.

The charging roller method either may be a direct current charging method in which direct current voltage is applied or a induction charging method in which alternative current voltage is applied to the charging roller.

Though the frequency of the voltage to be applied in the induction charging method can be optionally decided, a suitable frequency can be selected according to the relative speed of the electroconductive elastic roller and the image carrying member for preventing the occurrence of strobing or stripe pattern. The relative speed can be decided according to the size of the contacting area of the electroconductive elastic roller with the image carrier.

The electroconductive elastic roller is a roller composed of a center metal shaft covered with a layer of am electroconductive elastic material (hereinafter also referred to as the electroconductive elastic layer, H or electroconductive rubber layer).

As the rubber composition usable for the electroconductive rubber layer, polynorbornene rubber, ethylene-propylene rubber, acrylonitrile rubber and silicone rubber are cited. Such the rubber may be used singly or in a combination of two or more kinds.

An electroconductivity providing agent is added to the rubber composition to provide electroconductivity. Known carbon black (furnace black type carbon black or ketchen black) and metal powder such as tin oxide are usable. The using amount of the electroconductivity providing agent is about from 5 to 50 parts by weight to the weight of the entire rubber composition.

The rubber composition may be made to a electroconductive foamed rubber composition by adding a chemical for rubber and a additive for rubber additionally to the rubber raw material, a foaming agent and the electroconductivity providing agent according to necessity. As the chemicals for rubber and the additives for rubber, a vulcanizing agent such as sulfur and a peroxide, a vulcanization accelerator such as zinc oxide and stearic acid, a vulcanization accelerator such as sulfenamide type, thiraume type and thiazole type and granidine type, an anti-oxidant such as amine type, phenol type, sulfur type and phosphoric acid type, a UV absorbent, an anti-ozone degradation agent and an adhesiveness providing agent can be added. Moreover, various kinds of additive such as a reinforcing agent, a frictional index control agent, and an inorganic filler such as silica, talk and clay may be optionally selected to be used. The electroconductive rubber layer preferably has a direct current volume resistance of from $10^3$ to $10^7$ Ωcm.

A parting covering layer may be provided out side of the electroconductive elastic layer to prevent the adhesion of the remaining toner to the charging member. The covering layer functions such as prevention of oozing out of the oil from the elastic layer, unifying the resistance by canceling the unevenness of the resistance of the elastic layer, protecting the surface of the charging roller and controlling the hardness of the charging roller. The covering layer may be any one satisfying the above physical properties. The layer may be constituted by single layer or plural layers. As the material of the layer, resins such as hydrine rubber, urethane rubber, nylon and poly(vinylidene fluoride) are usable. The thickness of the covering layer is preferably from 100 to 1000 μm and the resistance is preferably from $10^5$ to $10^9$ Ω·cm. A method by adding an electroconductive material such as carbon black, a metal and a metal oxide can be applied for controlling the electric resistance of the covering layer.

It is preferable to add a powder to the surface layer (the electroconductive elastic layer or the covering layer) of the charging roller to control the surface roughness Rz of the charging roller. The powder may be either the powder of an inorganic or organic material. In the case of the inorganic material, silica powder is particularly preferable. In the case of the organic material, a urethane particle, a nylon particle, a silicone rubber particle and an epoxy resin particle are usable. These particles may be employed singly or in a state of mixture of two or more kinds. The material capable of controlling the surface roughness Rz of the surface layer into the range of from 0.05 to 10.0 μm is suitably selected. Such the purpose can be easily attained when the particle diameter of the powder is within the range of from 1 to 20 μm.

The surface roughness Rz is set within the range of from 0.05 to 10.0 μm because the roughness exceeding 10.0 μm causes considerable filming of the toner on the roller surface, and a roughness of less than 0.05 μm caused difficulty of the charging amount control since the contact between the charging roller and the photoreceptor drum so that the contacting area is increased.

The powder is preferably dispersed in the surface layer in a ratio of about from 5 to 20 parts by weight to 100 parts by weight of the resin.

The charging roller can be produced, for example, as follows. A metal rotatable axis (metal center shaft) and electroconductive elastic layer forming materials are put into a mold having a cylindrical molding space to form an electroconductive elastic layer on the outer circumference of the rotation axis by vulcanization. The rotation axis surrounded by the electroconductive elastic layer is taken out from the mold. On the other hand, a material such as urethane resin, and another additive such as a particles and an electric conductance providing agent are mixed by a mixing means such as a ball mill to prepare a surface layer forming material composition and the composition is coated as a uniform layer on the electroconductive elastic layer formed on the rotation axis and dried. And then the coated layer is thermally hardened. Thus the charging roller having double layer structure can be produced. The surface roughness Rz of the surface layer as the outermost layer of the charging roller thus produced is made to be from 0.05 to 10.0 μm.

Next, the magnetic brush charging device employing the magnetic brush as the charging member is described below.

Figure 2:
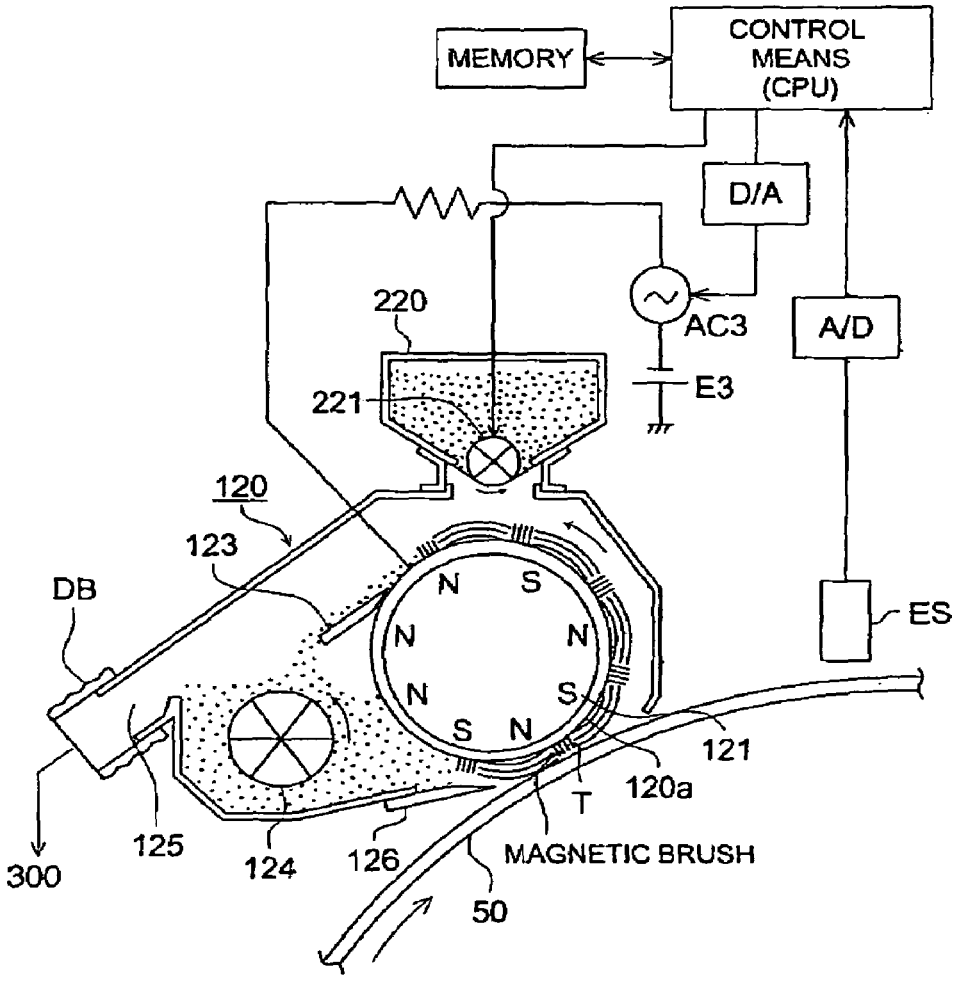
FIG. 2 shows an example of contacting type magnet brush charging device.
Figure 3:
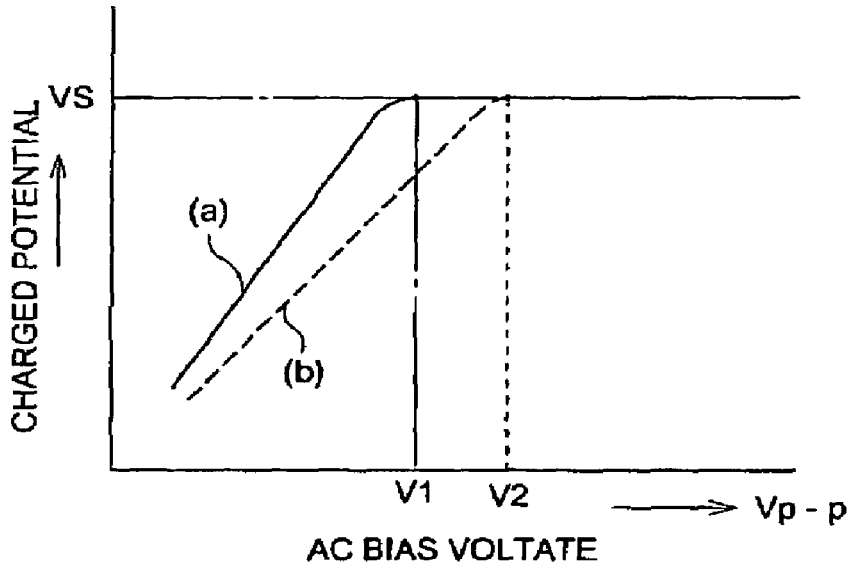
FIG. 3 shows relation of alternative current bias voltage and direct current bias voltage at the charging device.

FIG. 2 displays a contact type magnetic brush charging device. FIG. 3 shows the relation between the alternative current bias voltage and charged potential by the charging device shown in FIG. 2.

Generally a large volume average particle diameter of the magnetic particle causes a problem of unevenness of charge since the heads of the magnetic brush formed on the magnetic particle carrying member (conveying member) are coarse so as to easily cause unevenness of the magnetic brush even though the charging is carried out while applying the vibration of electric field. Such the problem can be solved by making smaller the volume average diameter of the magnetic particles. As a result of experiments, the appearance of the effect of the average diameter begins at not more than 200 μm, and the problem caused by the coarse head of the magnetic blush is substantially not posed particularly when the average diameter is not more than 150 μm. However, the particle is easily adhered to the surface of the photoreceptor drum 50 and the particle is easily scattered when the particles is excessively fine. Such the phenomena are generally become considerable in the region of the volume average particle diameter of not more than 20 μm even though the phenomena are related to the strength of the magnetic field affecting to the particle and the strength of the magnetization force of the particle caused by the magnetic field.

According the above reason, it is necessary that the volume average diameter of the magnetic particles is from 20 μm to 200 μm and the ratio of the magnetic particles each having the particle diameter of not more than one half the number average diameter of the magnetic particles is not more 30% in number. The strength of the magnetization force is preferably from 30 to 100 emu/g.

Such the magnetic particle can be prepared by particle of ferromagnetic metals the same as those used in the foregoing magnetic carrier of the double-component developer such as particle of iron, chromium, nickel and cobalt, particles of such the metals covered on the surface with resins such as a styrene type resin, a vinyl type resin, an ethylene type resin, a rosin-modified type resin, an acryl type resin, a polyamide resin, an epoxy resin and a polyester resin, or particles prepared by dispersing the ferromagnetic particles in the resin. The particles are selected according to the particle diameter by usually known average particle diameter classifying means.

The magnetic particle formed in a spherical shape is effective to make uniform the particle layer formed on the conveying member and to make possible to uniformly provide high bias voltage to the conveying member. The spherical-shaped particle results the following effects, (1) though the magnetic particle is easily magnetized and attracted in the direction of the major axis, the directional property is disappeared by making sphere and the magnetic particle layer is uniformly constituted and the occurrence of an area of locally lowered resistance and the evenness of the layer thickness can be prevented, (2) the edge portion formed by the usual particle is disappeared accompanied with the raising of the resistance of the magnetic particle and the concentration of the charge at the edge portion becomes not to occur, consequently the discharge from the magnet brush is uniformly performed to the photoreceptor drum 50 and the unevenness of the charge is not formed even when high bias voltage is applied to the charging magnetic particle carrying member.

For obtaining such the effects, it is preferable that the spherical magnetic particle is preferably one constituted by forming electroconductive particle so that the specific resistance of the magnetic particle is from $10^5$ to $10^{10}$ Ω·cm. The resistance is a value measured by the following procedure; the particles are put into a receptacle having a cross section area of 0.50 $cm^2$ and tapped. After that, voltage is applied so a to generate an electric field 1000 V/cm between a load applying member and an electrode set at the bottom of the receptacle while applying a load of 1 $kg/cm^2$ to the tapped particles and the current between the loading member and the bottom electrode is measured. When the specific resistance is low, the charge is injected to the magnetic particles and the magnetic particles tend to adhere to the surface of the photoreceptor 50 or the dielectric breakdown of the photoreceptor drum 50 by the bias voltage tends to occur. Besides, the specific resistance is high, the charging is not performed since the charge cannot be injected.

It is desirably that the magnetic particle to be employed for the contact type magnetic brush charging device 120 has a small specific gravity and suitable maximum magnetization so that the magnetic brush formed by the magnetic particle is lightly moved according to the vibrating electric field and the scattering of the particle to outside does not occur. In concrete, it has be found that good results can be obtained by the use of the particle having a specific gravity of not more than 6 and the maximum magnetization of from 30 to 100 emu/g, and particularly from 40 to 80 emu/g.

Over all, it is desired that the magnetic particle is made sphere so that the ratio of the major axis to the minor axis is not more than 3 and has no projected portion such as a needle-like portion or an edge portion, and has a specific resistance of from $10^5$ to $10^{10}$ Ωcm. Such the spherical magnetic particle can be produced by selecting ones having spherical shape as far as possible; and by using fine particles as far as possible and subjected to sphere making treatment after the preparation of dispersion of the particle in the resin or by forming the particle of the magnetic particle dispersion in the resin by a spray-drying method when the magnetic particle is the magnetic fine particle dispersion type.

According to FIGS. 2 and 3, the magnetic brush charging device 120 is constituted by a cylindrical charging sleeve 120*a* made from, for example, aluminum or stainless steel as the charging magnetic particle conveying mean which is faced to the rotating a photoreceptor 50 at the portion nearing the photoreceptor 50 (charging portion T) and rotated in the same direction (anti-clockwise direction); a magnet having N and S poles provided at the interior of the charging sleeve 120*a*; a magnetic brush for charging the photoreceptor 50, which is formed on the outer surface of the charging sleeve 120*a* by the magnet 121; a scraper 123 for scraping the magnetic brush on the charging sleeve 120*a* at the N-N pole portion of magnet 121; a stirring screw 124 for stirring the magnetic particles in the magnetic charging device 120 or for overflowing the used magnetic particles through the outlet opening 125 of the magnetic charging device 120 on the occasion of supplying the magnetic particles; and a head height regulation plate 126 for regulating the height of the magnetic brush. It is preferable that the charging sleeve 120*a* is rotatable with respect to the magnet 121 and is rotated at a circumference speed of from 0.1 to 1.0 times and in the same direction (anti-clockwise direction) as those of the photoreceptor drum 50 at the facing portion thereto. As the charging sleeve 120*a*, an electroconductive conveying member capable of being applied the charging bias voltage, and one having a structure in which the magnet 121 having a plurality of magnetic poles are provided in the electroconductive charging sleeve 120*a* is particularly preferred. On the surface of such the charging sleeve 120*a*, the magnetic particle layer is moved wave-wise by rising and falling, consequently new magnetic particles are continuously supplied and the small unevenness of the magnetic particle layer on the surface of charging sleeve 120*a* can be sufficiently covered by the wave so that the influence of the unevenness substantially does not cause any problem on practical use. The average surface roughness of the charging sleeve is preferably from 5.0 to 30 μm for stable and uniform conveying the magnetic particles. When the surface is too smooth, the conveying cannot be sufficiently performed, and when the surface is too rough, excessive electric current is generated from the projection portion. In both of the cases, the unevenness of the charging is easily formed. A sand blast treatment is preferred to make such the surface roughness. The external diameter of the charging sleeve 120*a* is preferably from 5.0 to 20 mm. The contacting area necessary for charging is kept by such the diameter. The contacting area is excessively larger than the necessary area causes excessive electric current and that smaller than the necessary area tends to cause the unevenness of charge. When the diameter is such as small, the magnetic particles tend to scatter or adhere to the photoreceptor. Consequently, the line speed of the charging sleeve 120*a* is preferably almost the same as or slower than that of the photoreceptor 50.

It is preferably that the magnetic particle layer formed on the charging sleeve is sufficiently scraped by the regulating means so as to have an uniform thickness. In the charging area, when the existing amount of the magnetic particles on the surface of the charging sleeve 120*a* is too large, the frictional wearing of the photoreceptor and the unevenness of the charging and the excessive electric current tend to be caused and the driving torque of the charging sleeve 120*a* is increased since the vibration of the magnetic particles cannot be sufficiently performed. In contrast, when the existing amount of the magnetic particles on the surface of the charging sleeve 120*a* is too small, the contact to the photoreceptor drum 50 is partially made insufficient and adhesion of the magnetic particles onto the surface of the photoreceptor drum 50 and the unevenness of charge are caused. As a result of experiments, it has been found that the preferable adhering amount of the magnetic particles in the charging area is from 100 to 400 mg/cm$^2$, and particularly preferably from 200 to 300 mg/cm$^2$. The adhering amount is the average value in the charging area of the magnetic brush. To the magnetic brush charging device 120 as the charging means, the charging bias is applied, which composed of direct current bias E3, alternative bias AC3 is overlapped according to necessity. For example, the direct current bias E3 of from −100 to −500 V having the same polarity as the toner (negative polarity in the present embodiment) and alternative bias AC3 of a frequency of from 1 to 5 kHz and a voltage of from 300 to 500 $V_{(p\text{-}p)}$ are applied to the charging sleeve 120*a* which is contacted to the external surface of photoreceptor drum 50 and rubs the surface for providing the charge. The charge is uniformly and rapidly injected onto the photoreceptor surface 10*a* through the magnetic brush since the vibrating electric field caused between the charging sleeve 120*a* and the photoreceptor drum 50 by the application of the alternative bias AC3.

The magnetic particles forming the magnetic brush on the charging sleeve 120*a* after charging the photoreceptor drum 50 are dropped by the scraper 123 from the charging sleeve surface and stirred by the stirring screw 124 rotating in the reverse direction (anti-clockwise direction) to the charging sleeve 120*a* at the portion near the charging sleeve, and then formed into the magnetic brush and conveyed to the charging zone T.

As is shown in FIG. 3, in the relation of the peak to peak voltage ($V_{(p\text{-}p)}$) of the alternative bias AC3 and the charged potential, the charged potential is increasing accompanied with raising of the peak to peak voltage, and the charged potential is saturated at a voltage almost the same of the current bias voltage VS by peak to peak voltage of V1 and the charged potential is almost not varied even when peak to peak voltage is increased. The electric resistance of the magnetic particle is increased accompanied with the repeating use by fusion of the toner on the particle even though the resistance is varied according to the environmental conditions. Consequently the characteristic curve (a) of the new magnetic particles at the initial period of the use drawn by solid line lies at the left side and the characteristic curve (b) of the magnetic particles after used for a prolonged period drawn by broken line lies at the right side.

In the contact type charging system, the variation of the charged potential of the photoreceptor drum 50 is measured by a potential meter ES when the designated direct current bias voltage corresponding to the charging potential is applied at the time of on of the of the power source or the start of the printing and then the voltage of the alternative bias AC3 is applied on increasing. The detected charged potential is converted to digital values by an A/D converter and input into a control means (CPU). In the control means, the value of the $V_{P\text{-}P}$ when the charged potential is reached to the designated saturated value of the charged potential VS is defined as the suitable bias voltage V1 and this value is applied to the printing process.

Namely, the value V1 of $V_{P\text{-}P}$ of alternative current bias AC3 is decided by gradually increasing (sweeping) the alternative bias from a low value on the occasion of the printing, and output from the control means in a form bias signals. The bias signals are converted to analogue values and send to the alternative bias AC3 so that the alternative bias AC3 outputs the decided peak to peak voltage V1. On the occasion of that, the controlling means reads out the a designated value V2 stored in the memory, which indicates the necessity of exchange of the magnetic particles degraded by repeating used, and compares with the peak to peak voltage V1. The suitable bias value V1 is raised accompanied with the repeat of the printing since the resistance of the magnetic particle is increased accompanied with the repeating use by mixing with the toner. As a result of that, the $V_{P\text{-}P}$ to be applied is increased so that the charging is made impossible. Though the image formation is continued as long as the measured voltage is smaller that the designated value V2, a stopping signal is output from the control means to stop the image formation processing, and a displaying means on the operation panel, not shown in the drawing, indicates an unusual situation when the measured value becomes larger than the designated value V2. According to the indication, a charging magnetic particles supplying bottle 220 is set on the magnetic brush charging means 120 and a bottom lid, not shown in the drawing, of the supplying bottle is opened so that the magnetic particles are dropped to be supplied into the magnetic brush charging means 120. Though the potential meter ES is employed for measuring the potential of the photoreceptor drum 50 in the above-mentioned, it is allowed that a direct current ammeter is connected to the bias power source and the $V_{P\text{-}P}$ of the alternative current bias is varied, and the value of the $V_{P\text{-}P}$ when the value current is saturated is set as the suitable value of the bias V1. The V1 thus determined is compared with the V2 and the magnetic particles are supplied when the V1 value exceeds the V2 value.

The magnetic particle for charging is exchanged on the occasion of the periodical maintenance, for example, every 50,000 times of printing. A signal for exchanging is output every maintenance prints memorized in the memory or the periodical maintenance every 50,000 times of printing, and a supplying roller 221 of a previously set charging magnetic particle supplying bottle 220 is rotated by a driving motor, not shown in the drawing, according to the exchanging signal so that the magnetic particles in the supplying bottle 220 is entirely dropped at once into the magnetic brush charging means 120. It is possible to control the image forming apparatus so that the apparatus is prepared for operation when the empty supplying bottle 220 after supplying is removed and a new supplying bottle 220 is set. Moreover, it is allowed that a signal for indicating the necessity of supplying is periodically displayed, for example, on and off of a signal lamp, on the operation panel, not shown in the drawing. According to such the displaying, the supplying bottle 220 is set on the magnetic brush charging means 120 and the lid at the bottom of the bottle, not shown in the drawing, is open to supply the magnetic particles.

The magnetic particles dropped into the charging means are conveyed by the rotating charging sleeve 120*a* and scraped from the surface of the charging sleeve 120*a* by the scraper 123 and supplied to the bottom of the magnetic brush charging means 120. Accompanied with that, the used magnetic particles contained in the magnetic brush charging device 120 particles are overflowed from the exhaustion opening 125 by the stirring screw 124 anti-clockwise rotated, and recovered into a common magnetic particle recovering container 300 through a duct DB. The amount of the magnetic particles supplied at once into the magnetic brush charging means 120 from the supplying bottle 220 is preferably fro 20 to 50% by weight of the entire amount of the magnetic particle contained in the magnetic brush charging means 120. When the supplying amount is less than 20% by weight, the effect of the exchange is not appeared and suitable charging cannot be performed since the amount of the newly supplied magnetic particles is too small, and when the amount is exceeds 50% by weight, newly supplied magnetic particles overflow.

According to the above-mentioned procedure, suitable charging ability can be maintained for a long period without degradation of the magnetic particles in the charging means.

Figure 4:
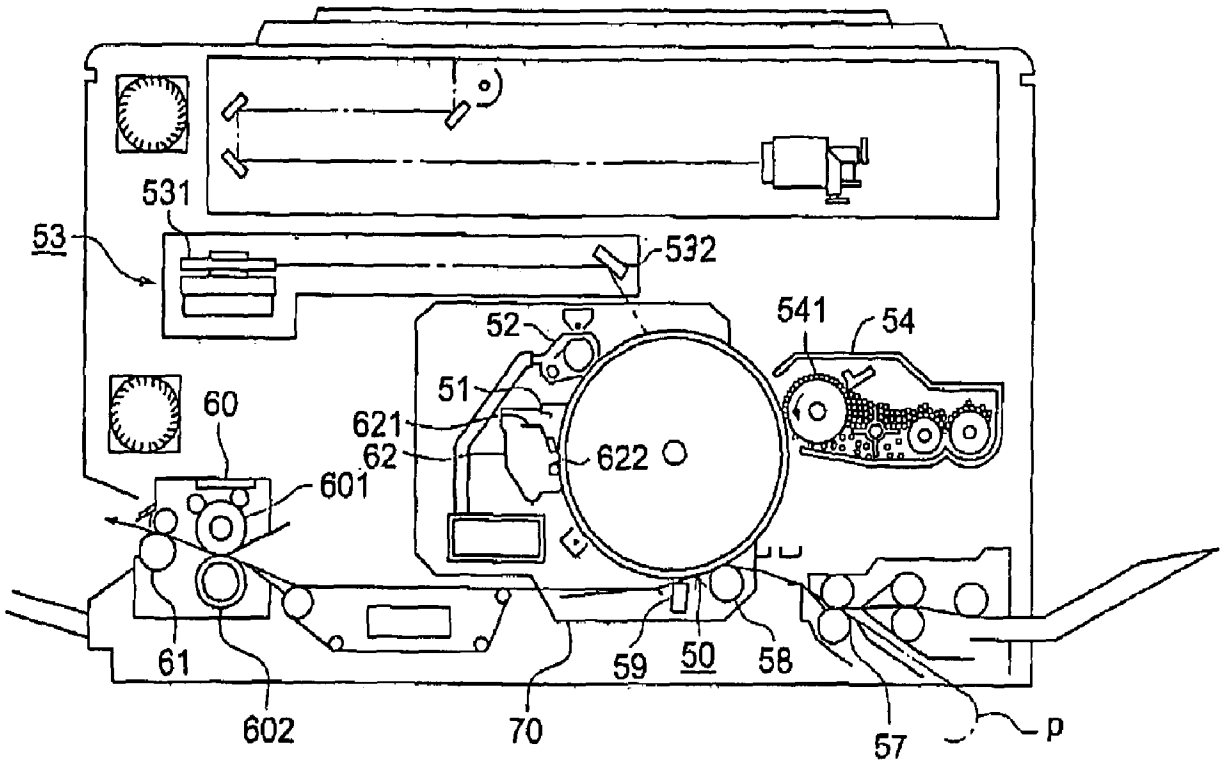
FIG. 4 shows the cross section of an example of image forming apparatus having a magnetic brush charging device.

FIG. 4 shows a cross section of an example of image forming apparatus having the magnetic brush charging device. In FIG. 4, 50 is the photoreceptor drum (photosensitive member) as the image carrier constituted by an organic photosensitive layer coated on the drum and has the constitution according to the invention thereon, which is grounded and clockwise rotated by driving. 52 is the magnetic brush charging device by which uniformly charges the outer surface of the photoreceptor drum 50 is uniformly charged (charging process). The outer surface of the photoreceptor drum may be discharged by exposure to light by a exposure means 51 using light emission diodes prior to the charging by the charging device 52 to remove the history of the last image formation.

After the uniformly charging on the photoreceptor, imagewise exposure is given by an image exposing device 53 according to the image signals (imagewise exposure process). The imagewise exposing means 53 has a laser diode, not shown in the drawing, as the light source. Static latent images are formed by scanning by a light beam through a rotating polygon mirror 531 and an fθ lens and reflected by a reflection mirror 532.

The static latent image is developed by a developing device 54 (developing process). The developing device 54 including a developer composed of a toner and a carrier is arranged around the photoreceptor drum 50, and the developing is performed by a rotating developing sleeve 541 which contains a magnet and holds the developer. The developer comprises a carrier such as one composed of the foregoing ferrite coated with a insulating resin and colored particle comprising the foregoing styrene-acryl resin as the principal material, a colorant such as carbon black, a charge controlling agent and a low molecular weight polyolefin, and externally added silica and titanium oxide. The developer is formed in a form of layer regulated to a thickness of from 100 to 600 μm on the developing sleeve 541 and conveyed to the developing zone for development. On the occasion of the development, the direct current bias, and the alternative current bias according to necessity, are usually applied between the photoreceptor drum 50 and the developing sleeve 541. The development is performed in a contact or non-contact state of the developer with the photoreceptor.

After the image formation, the image receiving material (referred also to recording paper) P is supplied into the transferring zone by rotation of a paper supplying roller 57 when the timing of the transfer is adjusted.

In the transferring zone, a transferring roller (transferring means) 58 is pressed against the circumference of the photoreceptor drum synchronizing with the timing of transferring and the image receiving paper is put between the photoreceptor drum 50 and the transferring roller 58 to transfer the toner image (transferring process).

After that, the image receiving material P is discharged by a separating brush (separating means) 59 which is pressed against to the photoreceptor drum almost the same time as the transferring roller, separated from the circumference of the photoreceptor drum 50 and conveyed by a fixing device 60. And then the toner is fused on the image receiving material by heating and pressing by a heating roller 601 and a pressing roller 602 (fixing process), and output to outside of the apparatus through an outputting roller 61. The transferring roller and the separating brush 59 are parted from the circumference of the photoreceptor drum 50 after passing of the image receiving material P for preparing the next image formation.

The toner remaining on the photoreceptor drum 50 is removed and the drum is cleaned by a cleaning blade 621 of a cleaning device 62 pressed against to the photoreceptor drum, and then the photoreceptor drum is subjected to discharging by the exposing means 51 and charged by the charging means 52 and progressed into the next image forming process.

70 is a processing cartridge formed by uniting the photoreceptor, charging device, transferring device, transferring device, separation device and cleaning device, which can be freely installed to and releasing from the apparatus.

In the image forming apparatus, the photoreceptor may be constituted by combining with the constituting elements such as the developing device and the cleaning device into an unified processing cartridge capable of being installed in or released from the apparatus. Moreover, at least one of the charging device, imagewise exposing device, developing device, transferring or separating device and cleaning device may be united with the photoreceptor to form a processing cartridge as one unit capable of being freely installed into or released from the apparatus using a guiding means such as rails.

When the image forming apparatus is used as a copy machine or a printer, the imagewise exposure is carried out by irradiating light reflected from or transmitted light through the original image to the photoreceptor or irradiating light by scanning by the laser beam, driving of a LED alley or a crystal shutter alley to the photoreceptor.

When the image forming apparatus is employed as a printer of facsimile apparatus, the imagewise exposing device 13 performs exposing for printing the received data.

Figure 5:
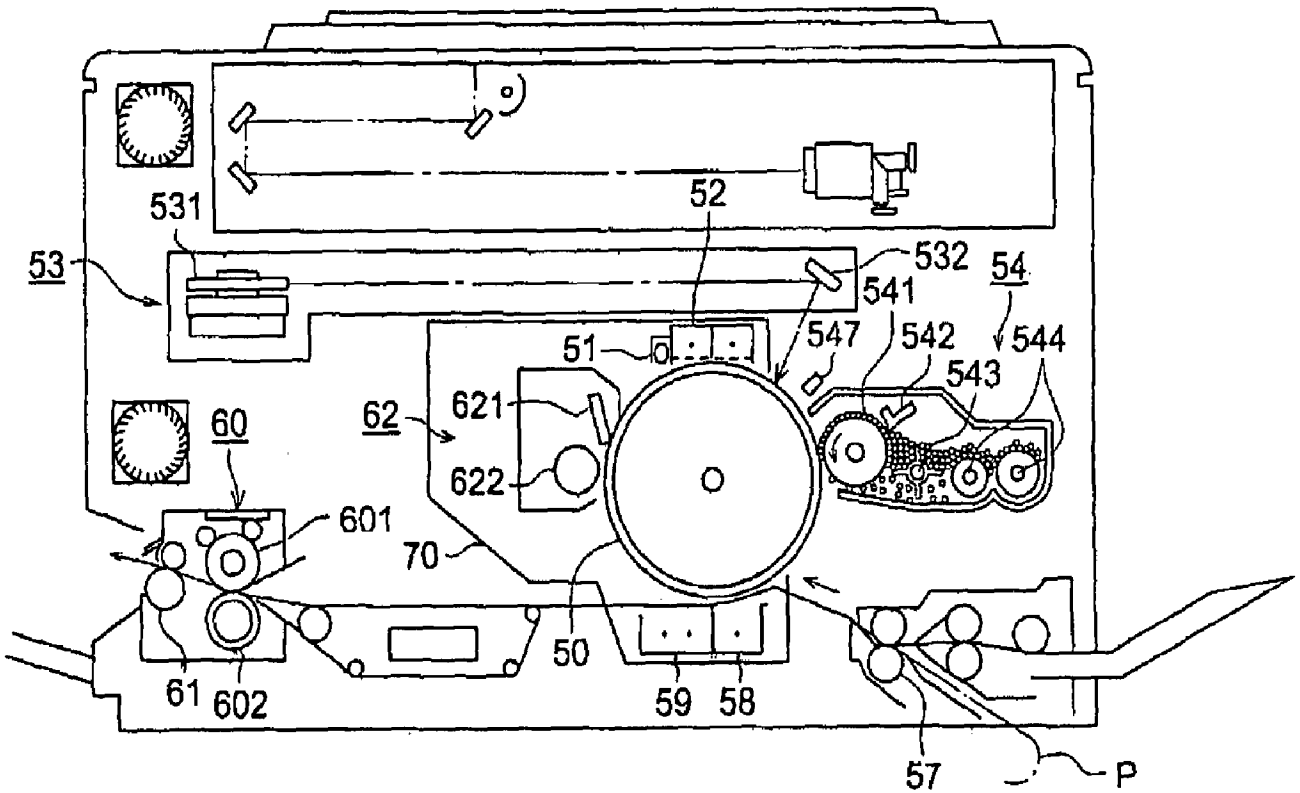
FIG. 5 shows the cross section of an example of image forming apparatus employing the non-contact charging system.

FIG. 5 shows a cross section of an example of image forming apparatus in which a corona charging system is installed.

In FIG. 5, ones each numbered the same as in FIG. 4 are the same as those in FIG. 4. Provided that 52 commonly indicates the charging device, but that is the contacting type charging device in FIG. 4 and a corona charging device in FIG. 5. In FIG. 5, the interior of the developing device 54 is constituted by developer stirring/conveying members 544 and 543, and the conveying amount regulation member 542; and the developer is stirred, conveyed and supplied to the developing sleeve. The amount of the developer is controlled by the conveying amount regulation member 542. The conveying amount of the developer is usually within the range of from 20 to 200 mg/cm$^2$, even though the amount is varied depending on the line speed of the organic electrophotographic photoreceptor and the specific gravity of the developer.

The foregoing electrophotographic photoreceptor is generally suitable for electrophotographic apparatuses such as an electrophotographic copy machine, a laser printer, a LED printer and a liquid crystal shutter type printer, and further can be widely applied for apparatuses utilizing the electrophotographic technology such as an apparatus of display, recording, light presswork, plate making and facsimile.

EXAMPLES

Though the invention is described in detail below referring the examples, the embodiment of the invention is not limited to the examples. In the followings, "part" means part by weight.

Example 1

Preparation of Photoreceptor 1

<Intermediate Layer (UCL)>

The following intermediate layer coating liquid was prepared, and the liquid was coated by an immersion coating method on a cylindrical aluminum substrate previously washed to form an intermediate layer.

| | |
|---|---|
| Component X: Titanium oxide (anatase type titanium oxide having a number average primary particle diameter of 35 nm) | 100 parts |
| Component Y: Isopropyltriisostearoyl titanate | 10 parts |
| Component Z-1: Vinyl Resin Type Segment A solution (Solution of silyl-modified Vinyl Type Resin A having a hindered amine group) | 100 parts |
| Component Z-2: Methyltrimethoxysilane | 70 parts |
| Component Z-3: Dimethyldimethoxysilane | 30 parts |
| Solvent 1: i-butyl alcohol | 100 parts |
| Solvent 2: Butyl cellosolve | 75 parts |
| Aluminum di-i-propoxyethylacetoacetate | 10 parts |

The above Component X, Component Y and fifty parts of Solvent 1 were mixed and the resultant mixture was dispersed in media for a whole day and night. The remaining parts of the above components were added to the resultant media dispersion and sufficiently stirred. And then 30 parts of purified water was dropped while stirring and reacted at 60° C. for 4 hours. After that, the dispersion was cooled by room temperature and 10 parts of an i-propyl alcohol solution of dioctyltindimaleate ester (containing 15% of solid ingredient) was added and stirred and then filtered to remove the media to prepare an intermediate coating liquid. The prepared coating liquid was coated on the cylindrical aluminum substrate by a circular coating amount regulating type coating apparatus and thermally hardened at 120° C. for 1 hour. Thus the intermediate layer containing the compound formed by a composition (the intermediate layer coating liquid) containing Components X, Y and Z and having a thickness of 2 μm was formed.

| <Charge generation layer> | |
|---|---|
| Titanylphthalocyanine (Bragg 2θ angle of 27.3 of the maximum peak in the Cu-Kα characteristic X ray diffraction) | 20 parts |
| Poly(vinyl butyral) (#6000-C, Denki Kagaku Kogyo Co., Ltd.) | 10 parts |
| t-butyl acetate | 700 parts |
| 4-methoxy-4-methyl-2-pentanone | 300 parts |

The above materials were mixed and dispersed by a sand mill to prepare a charge generation layer coating liquid. The coating liquid was coated to form a charge generation layer having a dry thickness of 0.3 μm on the intermediate layer.

| <Charge transfer layer (CTL)> | |
|---|---|
| Charge transfer agent ([4-(2,2-diphenylvinyl)phenyl]-di-p-tolylamine) | 75 parts |
| Polycarbonate resin (Iupilon Z300, Mitsubishi Gas Kagaku Co., Ltd.) | 100 parts |
| Methylene chloride | 750 parts |

The above materials were mixed and dissolved to prepare a charge transfer layer coating liquid. The coating liquid was coated on the charge generation layer by the immersion coating method to form a charge transfer layer having a dry thickness of 24 μm. Thus Photoreceptor 1 was prepared.

Preparation of Photoreceptor 2

Photoreceptor 2 having the intermediate layer containing the compound formed by the composition containing Components X, Y and Z was prepared in the same manner as in Photoreceptor 1 except that anatase type titanium oxide having a particle diameter of 15 nm was employed in place of that having the particle diameter of 35 nm.

Preparation of Photoreceptor 3

Photoreceptor 3 having the intermediate layer containing the compound formed by the composition containing Components X, Y and Z was prepared in the same manner as in Photoreceptor 1 except that anatase type titanium oxide having a particle diameter of 180 nm was employed in place of that having the particle diameter of 35 nm in the intermediate layer.

Preparation of Photoreceptor 4

Photoreceptor 4 having the intermediate layer containing the compound formed by the composition containing Components X, Y and Z was prepared in the same manner as in Photoreceptor 1 except that Vinyl Type Resin Segment B Solution (a solution of silyl-modified Vinyl Type Resin Segment B having a hindered phenol group) was employed in place of Vinyl type Resin Segment A Solution.

Preparation of Photoreceptor 5

Photoreceptor 5 having the intermediate layer containing the compound formed by the composition containing Components X, Y and Z was prepared in the same manner as in Photoreceptor 1 except that the following intermediate layer was employed in place of the foregoing intermediate layer.

(Intermediate Layer)

The following intermediate layer coating liquid was prepared and coated on the previously washed aluminum substrate to form an intermediate layer.

| | |
|---|---|
| Component X: Titanium oxide (anatase type titanium oxide having a number average primary particle diameter of 35 nm) | 100 parts |
| Component Y: γ-glycidoxypropyltrimethoxysilane | 10 parts |
| Component Z-1: Vinyl resin segment A solution (Solution of silyl-modified vinyl resin A having a hindered amine group) | 100 parts |
| Component Z-2: Methyltrimethoxysilane | 100 parts |
| Solvent 1: i-butyl alcohol | 100 parts |
| Solvent 2: Butyl cellosolve | 75 parts |
| Aluminum di-i-propoxyethylacetoacetate | 10 parts |

The above Component X, Component Y and fifty parts of Solvent 1 were mixed and the resultant mixture was dispersed in media for a whole day and night. The remaining parts of the above components were added to the resultant media dispersion and sufficiently stirred. And then 30 parts of purified water was dropped while stirring and reacted at 60° C. for 4 hours. After that, the dispersion was cooled by room temperature and 10 parts of an i-propyl alcohol solution of dioctyltindimaleate ester (containing 15% of solid ingredient) was added and stirred and then filtered to remove the media to prepare an intermediate coating liquid. The prepared coating liquid was coated on the cylindrical aluminum substrate by a circular coating amount regulating type coating apparatus and thermally hardened at 120° C. for 1 hour. Thus the intermediate layer containing the compound formed by a composition (the intermediate layer coating liquid) containing Components X, Y and Z and having a thickness of 10 μm was formed.

Preparation of Photoreceptor 6

Photoreceptor 6 having the intermediate layer containing the compound formed by the composition containing Components X, Y and Z was prepared in the same manner as in Photoreceptor 1 except that the following intermediate layer was employed in place of the foregoing intermediate layer.

<(Intermediate Layer)>

The following intermediate coating liquid was prepared and coated on the previously washed aluminum substrate to form an intermediate layer.

| | |
|---|---|
| Component X: Titanium oxide (anatase type titanium oxide having a number average primary particle diameter of 35 nm) | 100 parts |
| Component Y: γ-glycidoxypropyltrimethoxysilane | 20 parts |
| Component Z-1: Vinyl resin segment B solution (Solution of silyl-modified vinyl resin B having a hindered amine group) | 100 parts |
| Component Z-2: Methyltrimethoxysilane | 80 parts |
| Solvent 1: i-butyl alcohol | 100 parts |
| Solvent 2: Butyl cellosolve | 75 parts |
| Aluminum di-i-propoxyethylacetoacetate | 10 parts |

The above Component X, Component Y and fifty parts of Solvent 1 were mixed and the resultant mixture was dispersed in media for a whole day and night. The remaining parts of the above components were added to the resultant media dispersion and sufficiently stirred. And then 30 parts of purified water was dropped while stirring and reacted at 60° C. for 4 hours. After that, the dispersion was cooled by room temperature and 10 parts of an i-propyl alcohol solution of dioctyltindimaleate ester (containing 15% of solid ingredient) was added and stirred and then filtered to remove the media to prepare an intermediate coating liquid. The prepared coating liquid was coated on the cylindrical aluminum substrate by a circular coating amount regulating type coating apparatus and the thermally hardened at 120° C. for 1 hour. Thus the intermediate layer containing the compound formed by a composition (the intermediate layer coating liquid) containing Components X, Y and Z and having a thickness of 18 μm was formed.

Preparation of Photoreceptor 7

Photoreceptor 7 having the intermediate layer containing the compound formed by the composition containing Components X, Y and Z was prepared in the same manner as in Photoreceptor 1 except that the anatase type titanium oxide was replaced by rutile type titanium oxide (number average primary particle diameter: 35 nm) and Vinyl Resin Type Segment A of Component Z was replaced by Vinyl Type Resin Segment C solution (solution of silyl-modified Vinyl Type Resin Segment C).

Photoreceptor 8

Photoreceptor 8 having the intermediate layer containing the compound formed by the composition containing Components X, Y and Z was prepared in the same manner as in Photoreceptor 1 except that the titanium oxide as Component X in the intermediate layer was replaced by zinc oxide (number average primary particle diameter: 100 nm).

Photoreceptor 9

Photoreceptor 9 having the intermediate layer containing the compound formed by the composition containing Components X, Y and Z was prepared in the same manner as in Photoreceptor 1 except that the titanium oxide as Component X in the intermediate layer was replaced by zirconium oxide (number average primary particle diameter: 350 nm).

Photoreceptor 10

Photoreceptor 9 having the intermediate layer with a dry thickness of 18 μm containing a compound formed by the composition containing Components X, Y and Z was prepared in the same manner as in Photoreceptor 1 except that the titanium oxide of Component X in the intermediate layer was replaced by aluminum $Al_2O_3$ oxide (number average primary particle diameter: 35 nm).

Photoreceptor 11

Photoreceptor 9 having the intermediate layer with a dry thickness of 1 μm containing a compound formed by the composition containing Components X, Y and Z was prepared in the same manner as in Photoreceptor 1 except that, in the intermediate layer, Component Z-1 was omitted, the amount of Component Z-2 was changed from 70 parts to 140 parts, and the amount of Composition Z-3 was changed from 30 parts to 60 parts.

Photoreceptor 12

Photoreceptor 12 was prepared in the same manner as in Photoreceptor 1 except that the intermediate layer was changed by the following.

| Preparation of intermediate layer coating liquid | |
|---|---|
| Component X: Titanium oxide (anatase type titanium oxide pigment having a number average primary particle diameter of 35 nm) | 100 parts |
| Component Y: Isopropyltriisostearoyl titanate | 10 parts |
| Component Z: Polyamide resin (methoxymethylized nylon 6 having a methoxmethylized degree of 25%) | 150 parts |
| Isopropyl alcohol | 500 parts |

The polyimide was dissolved by heating in the isopropyl alcohol and mixed with the titanium oxide. The resultant mixture was dispersed by batch method for 10 hours by a sand mill dispersing machine in which the structure of the dispersing portion is treated by ceramics to prepare an intermediate coating layer coating liquid. The coating liquid was coated on the cylindrical aluminum substrate by the circulate coating amount regulation type coating apparatus to form an intermediate layer having a dry thickness of 2.0 μm.

Photoreceptor 12 showed solubility to the coating liquid solvent and the form of the intermediate layer was gradually dissolved.

Component X, Y and Z and the layer thickness of each of the intermediate layers are listed in Table 1.

TABLE 1

| Photo-receptor No. | Intermediate layer | | | |
|---|---|---|---|---|
| | Component X | Component Y | Component Z | Layer thickness (μm) |
| 1 | Anatase type titanium oxide: 35 nm | Isopropyltriisostearoyl titanate | Z-1: Vinyl Type Resin Segment A<br>Z-2: Methyltrimethoxysilane<br>Z-3: Dimethyldimethoxysilane | 2 |
| 2 | Anatase type titanium oxide: 15 nm | Isopropyltriisostearoyl titanate | Z-1: Vinyl Type Resin Segment A<br>Z-2: Methyltrimethoxysilane<br>Z-3: Dimethyldimethoxysilane | 2 |
| 3 | Anatase type titanium oxide: 180 nm | Isopropyltriisostearoyl titanate | Z-1: Vinyl Type Resin Segment A<br>Z-2: Methyltrimethoxysilane<br>Z-3: Dimethyldimethoxysilane | 2 |
| 4 | Anatase type titanium oxide: 35 nm | Isopropyltriisostearoyl titanate | Z-1: Vinyl Type Resin Segment B<br>Z-2: Methyltrimethoxysilane<br>Z-3: Dimethyldimethoxysilane | 2 |
| 5 | Anatase type titanium oxide: 35 nm | γ-glycidoxypropyl-trimethoxysilane | Z-1: Vinyl Type Resin Segment A<br>Z-2: Methyltrimethoxysilane | 10 |
| 6 | Anatase type titanium oxide: 35 nm | γ-glycidoxypropyl-trimethoxysilane | Z-1: Vinyl Type Resin Segment B<br>Z-2: Methyltrimethoxysilane | 18 |
| 7 | Rutile type titanium oxide: 35 nm | Isopropyltriisostearoyl titanate | Z-1: Vinyl Type Resin Segment C<br>Z-2: Methyltrimethoxysilane<br>Z-3: Dimethyldimethoxysilane | 2 |
| 8 | Zinc oxide: 100 nm | Isopropyltriisostearoyl titanate | Z-1: Vinyl Type Resin Segment C<br>Z-2: Methyltrimethoxysilane<br>Z-3: Dimethyldimethoxysilane | 2 |
| 9 | Zirconium oxide: 350 nm | Isopropyltriisostearoyl titanate | Z-1: Vinyl Type Resin Segment C<br>Z-2: Methyltrimethoxysilane<br>Z-3: Dimethyldimethoxysilane | 2 |
| 10 | Aluminum oxide: 35 nm | Isopropyltriisostearoyl titanate | Z-1: Vinyl Type Resin Segment A<br>Z-2: Methyltrimethoxysilane<br>Z-3: Dimethyldimethoxysilane | 18 |
| 11 | Anatase type titanium oxide: 35 nm | Isopropyltriisostearoyl titanate | Z-2: Methyltrimethoxysilane<br>Z-3: Dimethyldimethoxysilane | 1 |
| 12 | Anatase type titanium oxide: 35 nm | Isopropyltriisostearoyl titanate | Polyamide | 2 |
| 13 | — | Isopropyltriisostearoyl titanate | Z-1: Vinyl Type Resin Segment A<br>Z-2: Methyltrimethoxysilane<br>Z-3: Dimethyldimethoxysilane | 2 |

Photoreceptor 13

Photoreceptor 13 was prepared in the same manner as in Photoreceptor 1 except that the titanium oxide of Component X was omitted and the dry thickness of the layer was changed to 2.0 μm.

Samples for volume resistance measurement were prepared in the same time of the preparation of the photoreceptors 1 through 13 by coating each of the intermediate layer coating liquids on a poly(ethylene terephthalate) support on which an aluminum layer was deposited by evaporation and dried under a condition the same as that in the photoreceptor 1 to form a layer having a thickness of 10 μm. After that the volume resistance of each of the samples was measures. The volume resistance of the intermediate layers of Photoreceptors 1 through 13 were all not less than $1\times10^8$. The solubility in the solvent of the coating liquid of each of the intermediate layer was inspected at the same time. As a result of that, it was observed that all the intermediate layers except the intermediate layer of Photoreceptor 12 were not dissolved in the coating liquid solvent, and was confirmed that these intermediate layers had three dimensional crosslinked structure. In contrast, the intermediate layer of Evaluation The above-prepared samples were each installed in a—modified reversal development type digital copy machine Konica 7085, manufactured by Konica Corp., (having a scorotron charging device, a semiconductor imagewise exposing device (wavelength: 680 nm) and a reversal developing means and a printing speed of A4 size 85 sheets/minute), and the grid voltage of the charging device was adjusted to −750 V. The evaluation of the potential, image density, fogging, black spot, moire and sharpness were carried out as follows.

For image evaluation, 10,000 sheets of A4 size copy were continuously printed under each of conditions of low temperature humidity (LL: 10° C., 20% HR), a normal temperature and humidity (NN: 20° C., 60% HR) and high temperature and humidity (HH: 30° C., 80% HR) for image evaluation. Moreover, the potential at the unexposed area VHH and the potential at the exposed area VHL under the high temperature and humidity condition (30° C., 80% HR) and the potential at the unexposed area VLH and the potential at the exposed area VLL under the low temperature and humidity condition (10° C., 20% HR) were measured and |ΔVH| (absolute value of VHH−VHL) and |ΔVL| (absolute value of VLH−VLL) were calculated. The above evaluations on the potential were carried out by a potential meter just after the continuously copying of 10.000 sheets. The evaluations on the image density, fogging, black spot, moire and sharpness were performed as follows.

Operating condition of the modified Konica 7085

Line speed of photoreceptor: 420 mm/second

Moving time from the imagewise exposure process to the developing process: 0.108 seconds Charging Condition Charging device: Scorotron charging device (negative charge)

Exposure Condition

Targeted potential at the solid black image area: −50 V Exposing light beam: Light of 680 nm emitted a semi-conductor laser Developing condition Developer for Konica 7085 was used.

Transferring Condition

Transferring electrode: Corona charging system (positive charge)

Separating Condition

Separating means using a separating claw was used.

Cleaning Condition

A cleaning means was employed in which a cleaning blade touching in the counter direction.

Evaluation Items and Norms

Evaluation of remaining potential (potential variation at solid black image)

An A4 size original image including a character image having a pixel ratio of 7%, a halftone image, a solid white and a solid black image each occupying a quarter area of the image was copied for 10,000 times in the one sheet intermittent mode, and the difference of the potential at the solid black image |ΔV| between the initial and after 10,000 sheets copying was measured at the developing position. Smaller value of |ΔV| corresponds to smaller rising in the remaining potential.

◎: Potential variation at the solid black image area is less than 50 V. (Satisfactory)

○: Potential variation at the solid black image area is within the range of from 50 V to 150 V.

X: Potential variation at the solid black image area is more than 150 V.

Evaluation on Charged Potential (Potential Variation at the Solid White Image Area)

An A4 size original image including a character image having a pixel ratio of 7%, a halftone image, a solid white and a solid black image each occupying a quarter area of the image was copied for 10,000 times in the one sheet intermittent mode under the low temperature and humidity condition (10° C., 20% HR) and the high temperature and humidity condition (30° C., 80% HR), and the difference of the potential at the solid white image |ΔV| between the initial and after 10,000 sheets copying was measured at the developing position. Smaller value of |ΔV| corresponds to smaller variation in the charged potential.

◎: Potential variation at the solid white image area is less than 50 V. (Satisfactory)

○: Potential variation at the solid white image area is within the range of from 50 V to 150 V.

X: Potential variation at the solid white image area is more than 150 V.

Image Density

Evaluation was performed with respect to the low temperature and humidity condition (LL: 10° C., 20% HR) and the high temperature and humidity condition (30° C., 80% HR) and measured by RD-918 manufactured by Macbeth Co., Ltd. The density was relative reflective density when the reflective density of the paper was defined as 0. The image density was lowered accompanied with the increasing of the remaining potential. The measurement was carried out at the black solid image area after copying of 10,000 sheets.

◎: The density of the black solid image was more than 1.2 under both of the conditions of low temperature and humidity and high temperature and humidity. (Satisfactory)

○: The density of the black solid image was from 1.0 to 1.2 under both of the conditions of low temperature and humidity and high temperature and humidity.

X: The density of the black solid image was less than 1.0 under at least one of conditions of low temperature and humidity and high temperature and humidity.

Fogging

Fogging was evaluated with respect to the low temperature and humidity (LL: 10° C., 20% HR) and the high temperature and humidity (HH: 30° C., 80% HR). The fog was measured by reflective density of the white solid image area using RD-19 manufactured by Macbeth Co., Ltd. The reflective density was evaluated by the relative density when the density of A4 paper before use was defined as 0.000.

◎: The density was less than 0.010 under both of the conditions of low temperature and humidity and high temperature and humidity. (Satisfactory)

○: The density was from 0.010 to 0.020 under both of the conditions of low temperature and humidity and high temperature and humidity.

X: The density was more than 0.020 under at least one of conditions of low temperature and humidity and high temperature and humidity.

Black spot (Black spots was evaluated with respect to one of the conditions of the low temperature and humidity and the high temperature and humidity under which more black spots occurred.)

The black spots was evaluated according to the number per sheet of A4 size paper of visible spots and agree with the cycle of the photoreceptor.

◎: Frequency of black spot of not less than 0.4 mm: Not less than 3 spots/A4 in all the copied image ○: Frequency of black spot of not less than 0.4 mm: one ore more copies having from 4 to 10 spots were found.

X: Frequency of black spot of not less than 0.4 mm: one ore more copies having 11 or more spots were found. Evaluation of moire (Evaluation was performed with respect to the halftone image and white background formed image under the ordinary temperature and humidity.)

◎: Any moire was not formed in both of the halftone image and the white background image.

○: The more slightly occurred in the halftone image.

X: The moire considerably occurred in the halftone image or the white background image.

Sharpness

The sharpness of the image was performed with respect to the images formed under the low temperature and humidity condition (10° C., 20% HR) and the high temperature and humidity condition (30° C., 80% HR). Images of 3- and 5-point characters were printed and evaluated according to the following norms.

◎: Both of the 3- and 5-point characters printed under the low temperature and humidity condition and the high temperature and humidity condition were clear and easily readable. (Satisfactory)

○: A part of the 3-point characters formed under at least one of the low temperature and humidity condition and the high temperature and humidity condition was not readable and the 5-point characters were clear and easily readable.

X: The 3-point characters formed under at least one of the low temperature and humidity condition and the high temperature and humidity condition were almost not readable and a part or all were not readable.

Results of the evaluation are listed in Table 2.

TABLE 2

| Photoreceptor | Evaluation on potential (Remaining potential) | | Evaluation on potential (Charged potential) | | Evaluation on image | | | | |
|---|---|---|---|---|---|---|---|---|---|
| | | | | | Image | | Black | | |
| No. | LL | HH | LL | HH | density | Fog | spots | Moire | Sharpness |
| 1 | ◎ | ◎ | ◎ | ◎ | ◎ | ◎ | ◎ | ◎ | ◎ |
| 2 | ◎ | ◎ | ◎ | ◎ | ◎ | ◎ | ◎ | ◎ | ◎ |
| 3 | ◎ | ◎ | ◎ | ◎ | ◎ | ◎ | ◎ | ◎ | ◎ |
| 4 | ◎ | ◎ | ◎ | ◎ | ◎ | ◎ | ◎ | ◎ | ◎ |
| 5 | ◎ | ◎ | ◎ | ◎ | ◎ | ◎ | ◎ | ◎ | ◎ |
| 6 | ◎ | ◎ | ◎ | ◎ | ◎ | ◎ | ◎ | ◎ | ◎ |
| 7 | ○ | ◎ | ◎ | ◎ | ○ | ◎ | ○ | ◎ | ○ |
| 8 | ○ | ○ | ○ | ○ | ○ | ○ | ○ | ◎ | ◎ |
| 9 | ○ | ○ | ○ | ○ | ○ | ○ | ○ | ◎ | ◎ |
| 10 | ○ | ○ | ◎ | ◎ | ○ | ◎ | ◎ | ◎ | ◎ |
| 11 | ○ | ○ | ◎ | ○ | ○ | ○ | ◎ | ◎ | ○ |
| 12 | X | X | ○ | ○ | X | ○ | ○ | ○ | X |
| 13 | X | X | X | ○ | X | X | X | X | X |

It is under stood from Table 2, that Photoreceptors 1 through 11 are excellent in the remaining potential and the charged potential under the low temperature and humidity condition and the high temperature and humidity condition, consequently the image density is satisfactory and the fog density is low. Furthermore, the occurrence of the black spots is considerably improved. As a result of that, the electrophotographic images having a high sharpness are obtained. Particularly, the improving effects of Photoreceptors 1 through 6 employing the anatase type titanium oxide as Component X, the vinyl type resin segment (Component Z-1) and the reactive organic silicon compound (Components Z-2 or Z-3) are considerable compared with Photoreceptors 7 through 11. In contrast, in Photoreceptor 12 employing the polyamide resin as the binder of the intermediate layer and no Component Z, rising in the remaining potential is large and the image density is lowered, and lowering in the sharpness is resulted. In Photoreceptor 13 employing no Component X in the intermediate layer, rising in the remaining potential and variation in the charged potential are large and the image density is lowered, and the fog, the black spots and the moire are formed as the result of that, the sharpness is degraded.

The satisfactory photoreceptors could be obtained which were the potential variation depending on the environmental conditions was small and the black spots and the moire did not occur as was displayed in Example 1.

The photoreceptors capable of forming a good electrophotographic image having the high image density and the high sharpness could be provided in which the variation in the charged potential and the remaining potential were small and the occurrence of the image defects such as the black spots and the moire were prevented under the low temperature and humidity condition and the high temperature and humidity condition. Moreover, the photoreceptor capable of forming an electrophotographic image having the high image density and the high sharpness could be provided, in which the variation in the charged potential and the remaining potential were lowered and the occurrence of the image defects such as the black spots and the moire was prevented; such the defects tended to occur by the use of the high sensitive and high speed charge generation material and charge transfer material.

Example 2

Photoreceptors were prepared as follows.

Preparation Photoreceptor 2-1

In Photoreceptor 1, the dry thickness of the intermediate layer was made to 10 μm, and the following protective layer was provided.

| (Protective layer) | |
|---|---|
| Component Z-1: Slily group-containing vinyl type resin segment A solution (Solid ingredient: 50% by weight) | 100 parts |
| Component Z-1: Methyltrimthoxysilane | 70 parts |
| Component Z-3: 3-glycidoxypropyltrimethoxysilane | 30 parts |
| 2-butyl alcohol | 100 parts |
| Butyl cellosolve | 75 parts |
| Aluminum di-i-propoxyethylacetoacetate | 10 parts |

The above composition was sufficiently stirred and 30 parts of purified water was dropped and reacted for 4 hours at 60° C., and then cooled by the room temperature. To the resultant, 10 parts of a 2-propyl alcohol solution of dioctyltindimaleate ester (content of the solid component: 15% by weight and 10 parts of a charge transfer subunit forming compound (B-1) as Component T were added and stirred to prepare coating liquid. The coating liquid was coated on the charge transfer layer by the circular coating amount regulating type coating apparatus to form a protective layer having a dry thickness of 3 μm, and thermally hardened at 120° C. for 1 hour. Thus Photoreceptor 2-1 was prepared which has the intermediate layer containing the compound formed by the composition comprising Components X, Y and Z, and the protective layer containing the compound formed by the composition comprising Components Z and T.

Preparation of Photoreceptor 2-2

Photoreceptor 2-2 having the intermediate layer containing the compound formed by the composition comprising Components X, Y and Z, and the protective layer containing the compound formed by the composition comprising Components Z and T was prepared in the same manner as in Photoreceptor 2-1 except that the particle diameter of the titanium oxide having a particle diameter 35 nm was replaced by anatase type titanium oxide pigment having a particle diameter of 15 nm.

Preparation of Photoreceptor 2-3

Photoreceptor 2-3 having the intermediate layer containing the compound formed by the composition comprising Components X, Y and Z, and the protective layer containing the compound formed by the composition comprising Components Z and T was prepared in the same manner as in Photoreceptor 2-1 except that the particle diameter of the titanium oxide having a particle diameter 35 nm was replaced by anatase type titanium oxide pigment having a particle diameter of 180 nm.

Preparation of Photoreceptor 2-4

Photoreceptor 2-4 having the intermediate layer containing the compound formed by the composition comprising Components X, Y and Z, and the protective layer containing the compound formed by the composition comprising Components Z and T was prepared in the same manner as in Photoreceptor 2-1 except that Vinyl Type Resin Segment A solution in the intermediate layer coating liquid was replaced by Vinyl Type Resin Segment B solution (the solution of silyl-modified vinyl type resin B having a hindered phenol group).

Preparation of Photoreceptor 2-5

Photoreceptor 2-5 having the intermediate layer containing the compound formed by the composition comprising Components X, Y and Z, and the protective layer containing the compound formed by the composition comprising Components Z and T was prepared in the same manner as in Photoreceptor 2-1 except that the intermediate layer was changed to the following.

(Intermediate Layer)

The layer having a dry thickness of 4 μm was formed by the same method employing the composition the same as that used in Photoreceptor 5 of Example 1.

Preparation of Photoreceptor 2-6

Photoreceptor 2-6 having the intermediate layer containing the compound formed by the composition comprising Components X, Y and Z, and the protective layer containing the compound formed by the composition comprising Components Z and T was prepared in the same manner as in Photoreceptor 2-1 except that the intermediate layer was changed to the following and the thickness of the layer was changed to 20 μm.

<Intermediate Layer (UCL)>

The inter mediate layer having a thickness of 20 μm was formed by the composition the same as that of the intermediate layer of Photoreceptor 6 of Example 1.

Preparation of Photoreceptor 2-7

Photoreceptor 2-7 having the intermediate layer containing the compound formed by the composition comprising Components X, Y and Z, and the protective layer containing the compound formed by the composition comprising Components Z and T was prepared in the same manner as in Photoreceptor 2-1 except that the anatase type titanium oxide as Component X was replaced by a rutile type titanium oxide (number average primary particle diameter: 35 nm) and Vinyl Type Resin Segment A solution was replaced by Vinyl Type Resin Segment B solution.

Preparation of Photoreceptor 2-8

Photoreceptor 2-8 having the intermediate layer containing the compound formed by the composition comprising Components X, Y and Z, and the protective layer containing the compound formed by the composition comprising Components Z and T was prepared in the same manner as in Photoreceptor 2-1 except that the titanium oxide was replaced by zinc oxide (number average primary particle diameter: 100 nm).

Preparation of Photoreceptor 2-9

Photoreceptor 2-9 having the intermediate layer containing the compound formed by the composition comprising Components X, Y and Z, and the protective layer containing the compound formed by the composition comprising Components Z and T was prepared in the same manner as in Photoreceptor 2-1 except that the titanium oxide was replaced by zirconium oxide (number average primary particle diameter: 350 nm).

Preparation of Photoreceptor 2-10

Photoreceptor 2-10 having the intermediate layer containing the compound formed by the composition comprising Components X, Y and Z, and the protective layer containing the compound formed by the composition comprising Components Z and T was prepared in the same manner as in Photoreceptor 2-1 except that the titanium oxide was replaced by aluminum oxide $Al_2O_3$ (number average primary particle diameter: 35 nm).

Preparation of Photoreceptor 2-11

Photoreceptor 2-11 having the intermediate layer containing the compound formed by the composition comprising Components X, Y and Z, and the protective layer containing the compound formed by the composition comprising Components Z and T was prepared in the same manner as in Photoreceptor 2-1 except that Component Z-1 was omitted and the amount of Components Z-2 and Z-3 were changed from 70 to 140 parts and from 30 parts to 60 parts, respectively.

Photoreceptors 2-12 through 2-14

Photoreceptors 2-12 through 2-14 were prepared in the same manner as in Photoreceptor 2-1 except that the kind, amount and the layer thickness were changed were changed as listed in Table 3.

Photoreceptor 2-15

Photoreceptor 2-15 was prepared in the same manner as in Photoreceptor 2-1 except that the intermediate layer was replaced by the following intermediate layer.

Preparation of the Intermediate Layer Coating Liquid

An intermediate layer having a thickness of 10 μm was formed employing an intermediate layer coating liquid the same as that used in Photoreceptor 12 of Example 1.

Photoreceptor 2-16

Photoreceptor 2-16 was prepared in the same manner as in Photoreceptor 2-1 except that the titanium oxide as Component X in the intermediate layer was omitted and the dry thickness of the layer was changed to 10 μm.

The different points between each of the intermediate layers and the protective layer are listed in Tables 3 and 4.

TABLE 3

| Photoreceptor No. | Intermediate layer: Component X | Component Y | Component Z | Layer thickness (μm) | Protective layer: Component Z (Part) | Layer thickness (μm) |
|---|---|---|---|---|---|---|
| 2-1 | Anatase type titanium oxide: 35 nm | *1 | *3 | 10 | *9 | 3 |
| 2-2 | Anatase type titanium oxide: 15 nm | *1 | *3 | 10 | *9 | 3 |
| 2-3 | Anatase type titanium oxide: 180 nm | *1 | *3 | 10 | *9 | 3 |
| 2-4 | Anatase type titanium oxide: 35 nm | *1 | *4 | 10 | *9 | 3 |
| 2-5 | Anatase type titanium oxide: 35 nm | *2 | *5 | 4 | *9 | 3 |
| 2-6 | Anatase type titanium oxide: 35 nm | *2 | *6 | 20 | *9 | 3 |
| 2-7 | Rutile type titanium oxide: 35 nm | *1 | *7 | 10 | *9 | 3 |
| 2-8 | Zinc oxide: 100 nm | *1 | *7 | 10 | *9 | 3 |
| 2-9 | Zirconium oxide: 350 nm | *1 | *7 | 10 | *9 | 3 |
| 2-10 | Aluminum oxide: 35 nm | *1 | *3 | 10 | *9 | 3 |

*1: Isopropyltriisoatearoyl titanate
*2: γ-glycidoxypropyltrimethoxysilane
*3: Z-1: Vinyl type resin segmsnt A
Z-2: Methyltrimethoxysilane
Z-3: Dimethyldimethoxysilane
*4: Z-1: Vinyl type resin segmsnt B
Z-2: Methyltrimethoxysilane
Z-3: Dimethyldimethoxysilane
*5: Z-1: Vinyl type resin segmsnt A
Z-2: Methyltrimethoxysilane
*6: Z-1: Vinyl type resin component B
Z-2: Methyltrimethoxysilane
*7: Z-1: Vinyl type resin segmsnt C
Z-2: Methyltrimethoxysilane
Z-3: Dimethyldimethoxysilane
*9: Z-1: Vinyl type resin segmsnt A (100)
Z-2: Methyltrimethoxysilane (70)
Z-3: Dimethyldimethoxysilane (30)

TABLE 4

| Photoreceptor No. | Intermediate layer: Component X | Component Y | Component Z | Layer thickness (μm) | Protective layer: Component Z | Layer thickness |
|---|---|---|---|---|---|---|
| 2-11 | Anatase type titanium oxide: 35 nm | *1 | *8 | 10 | *9 | 3 |
| 2-12 | Anatase type titanium oxide: 35 nm | *1 | *3 | 10 | *10 | 0.5 |
| 2-13 | Anatase type titanium oxide: 35 nm | *1 | *3 | 10 | *11 | 5 |
| 2-14 | Anatase type titanium oxide: 35 nm | *1 | *3 | 10 | *12 | 3 |
| 2-15 | Anatase type titanium oxide: 35 nm | *1 | Polyamide | 10 | *9 | 3 |
| 2-16 | — | | *3 | 10 | *9 | 3 |

*1: Isopropyltriisostearoyl titanate
*3: Z-1: Vinyl type resin segment A
Z-2: Methyltrimethoxysilane
Z-3: Dimethyldimethoxysilane
*8: Z-2: Methyltrimethoxysilane
Z-3: Dimethyldimethoxysilane
*9: Z-1: Vinyl type resin segment A (100)
Z-2: Methyltrimethoxy silane (70)
Z-3: Dimethyldimethoxysilane (30)
*10: Z-1: Vinyl type resin segment B (100)
Z-2: Methyltrimethoxysilane (80)
*11: Z-1: Vinyl type resin segment C (100)
Z-2: Methyltrimethoxysilane (70)
Z-3: Dimethyldimethoxysilane (30)
*12: Z-2: Methyltrimethoxysilane (140)
Z-3: Dimethyldimethoxysilane (60)

Samples for volume resistance measurement were prepared in the same time of the preparation of the photoreceptors 2-1 through 2-16 by coating each of the intermediate layer coating liquids on a poly(ethylene terephthalate) support on which an aluminum layer was deposited by evaporation and dried under a condition the same as that in the photoreceptor 1 to form a layer having a thickness of 10 μm. After that the volume resistance of each of the samples was measures. The volume resistance of the intermediate layers of Photoreceptors 2-1 through 2-17 were all not less than $1\times10^8$. The solubility in the solvent of the coating liquid of each of the intermediate layer was inspected at the same time. As a result of that, it was observed that all the intermediate layers except the intermediate layer of Photoreceptor 2-15 were not dissolved in the coating liquid solvent, and was confirmed that these intermediate layers had three dimensional cross linked structure. In contrast, the intermediate layer of Photoreceptor 2-15 showed solubility to the coating liquid solvent and the form of the intermediate layer was gradually dissolved.

Evaluation 1

(Evaluation Using the Charging Roller)

The above-prepared Photoreceptors 2-1 through 2-16 were each installed in the reversal development digital copying machine Konica 7050 manufactured by Konica Corp. and evaluated on the following items under the high temperature and humidity condition (30° C., 60% RH) and the low temperature and humidity condition (10° C., 20% RH). Results of the evaluation are listed in Table 5.

Charging Roller.

Polynorbornene rubber, carbon black and naphthalene type oil and, according to necessity, a vulcanizing agent, a vulcanization accelerating agent and an additives were mixed and charged into a metal mold to form an electroconductive elastic layer. The resultant layer was immersed in a liquid composition composed of polyesterurethane, resin particles having a diameter of approximately 0.5 μm, carbon black and a solvent (MEK/dimethylformamide) so as to be coated by it, and the coated layer was dried and thermally treated to form a covering layer comprising the urethane resin. Thus Charging Roller 1 was prepared. The resistance of the electroconductive elastic layer and the covering layer were each $3.2\times10^4$ Ω·cm and $5.2\times10^5$ Ω·cm, respectively. The surface roughness of the charging roller Rz was 0.1.

Line speed of the photoreceptor: 280 mm/sec.

Targeted potential at the light exposed are: The exposure amount was set so as to make the potential to less than −50 V.

Light beam for exposing: The imagewise exposure having a dot density of 800 dpi was performed (dpi was the number of dot per 2.54 cm).

Spot area of laser beam was $0.8\times10^{-9}$ $m^2$. The laser was a semiconductor laser emitting light of 780 nm.

Transferring condition: Static transference using a corotron electrode.

Separation condition: A separation means using a separating electrode was employed to which alternative current bias was applied.

Cleaning: A rubber blade was employed, which was controlled so that the touching angle with the photoreceptor was to be 20° and the touching load to be 20 g/cm.

Evaluation Items and Methods Evaluation items and evaluation norms.

Evaluation on Remaining Potential (Potential Variation at the Solid Black Image)

The evaluation was performed according to the norms the same as those in Example 1.

Evaluation on Remaining Potential (Potential Variation at the Solid White Image)

The evaluation was performed according to the norms the same as those in Example 1.

Image density: Evaluation was performed with respect to the conditions of low temperature and humidity (LL: 10° C., 20% RH) and high temperature and humidity (HH: 30° C., 80% RH). The evaluation was performed according to the same norms as those in Example 1.

Fog: Evaluation was performed with respect to the conditions of low temperature and humidity (LL: 10° C., 20% RH) and high temperature and humidity (HH: 30° C., 80% RH). The evaluation was performed according to the same norms as those in Example 1.

Dielectric breakdown: Evaluation was performed with respect to the conditions of low temperature and humidity (LL: 10° C., 20% RH) and high temperature and humidity (HH: 30° C., 80% RH).

○: No dielectric breakdown occurred on the photoreceptor under the LL and HH conditions.

X: Dielectric breakdown occurred on the photoreceptor under the LL or HH conditions.

Periodical image defects (high temperature and humidity condition (30° C., 80% RH)): The occurrence of defect was judged by the number of visible black spot and black line per A4 size image which are agreed with the cycle of the photoreceptor.

◎: The frequency of the image defect of not less than 0.4 mm was not more than 5/A4 in the entire copied images (satisfactory).

○: The frequency of the image defect of not less than 0.4 mm was from 6 to 10/A4 in one of more sheets of copied images.

X: The frequency of the image defect of not less than 0.4 mm was not less than 11/A4 in one of more sheets of copied images.

The sharpness of the image was evaluated by collapsing of the 3-point and 5-point characters printed under the low temperature and humidity condition (10° C., 20% RH) and the high temperature and humidity condition (30° C., 80% RH) according to the following norms.

◎: Images were not spread, the images of the 3-point and 5-point characters were clear and easily readable.

○: Images were spread a little, a part of the images of the 3-point characters could not be read and the 5-point characters were clear and easily readable.

X: Images were spread, the image of 3-point characters were most not readable and a part or all of the 5-point characters were not readable also.

TABLE 5

| Photoreceptor No. | Potential evaluation (Remaining potential) LL | Potential evaluation (Remaining potential) HH | Potential evaluation (Charged potential) LL | Potential evaluation (Charged potential) HH | Image evaluation: Image density | Image evaluation: Fog | Image evaluation: Dielectric breakdown | Image evaluation: Black spot | Image evaluation: Moire | Image evaluation: Sharpness |
|---|---|---|---|---|---|---|---|---|---|---|
| 1 | ◎ | ◎ | ◎ | ◎ | ◎ | ◎ | ○ | ◎ | ◎ | ◎ |
| 2 | ◎ | ◎ | ◎ | ◎ | ◎ | ◎ | ○ | ◎ | ◎ | ◎ |
| 3 | ◎ | ◎ | ◎ | ◎ | ◎ | ◎ | ○ | ◎ | ◎ | ◎ |
| 4 | ◎ | ◎ | ◎ | ◎ | ◎ | ◎ | ○ | ◎ | ◎ | ◎ |
| 5 | ◎ | ◎ | ◎ | ◎ | ◎ | ◎ | ○ | ◎ | ◎ | ◎ |
| 6 | ◎ | ◎ | ◎ | ◎ | ◎ | ◎ | ○ | ◎ | ◎ | ◎ |
| 7 | ○ | ◎ | ◎ | ◎ | ○ | ◎ | ○ | ○ | ◎ | ○ |
| 8 | ○ | ○ | ○ | ○ | ○ | ○ | ○ | ○ | ◎ | ◎ |
| 9 | ○ | ○ | ○ | ○ | ○ | ○ | ○ | ○ | ◎ | ◎ |
| 10 | ○ | ◎ | ◎ | ○ | ○ | ◎ | ○ | ◎ | ◎ | ◎ |
| 11 | ○ | ○ | ◎ | ○ | ○ | ○ | ○ | ◎ | ◎ | ○ |
| 12 | ◎ | ◎ | ◎ | ◎ | ◎ | ◎ | ○ | ◎ | ◎ | ◎ |
| 13 | ◎ | ◎ | ◎ | ◎ | ◎ | ◎ | ○ | ◎ | ◎ | ◎ |
| 14 | ○ | ◎ | ◎ | ○ | ○ | ○ | ○ | ◎ | ◎ | ○ |
| 15 | X | X | ○ | ○ | X | ○ | X | ○ | ○ | X |
| 16 | X | ○ | ○ | X | X | X | X | ○ | X | X |

It is under stood from Table 5, Photoreceptors 2-1 through 2-14 having the intermediate layer containing the compound formed from the composition containing Components X, Y and Z, the photosensitive layer and the protective layer containing the compound formed from the composition containing Components Z and T, provided on the intermediate layer, are excellent in the stability of the remaining potential and the charged potential, and the sufficient image density and lowered fog density are resulted. Moreover, no dielectric breakdown occurs and the black spot occurrence is considerably improved, consequently, the satisfactory images can be obtained even though the contact charging system is utilized. Particularly, Photoreceptors 2-1 through 2-6, 2-12 and 2-13 in each of which anatase type titanium oxide is used as Component X, the vinyl type resin segment (Component Z-1) and the reactive organic silicon compound (Components Z-2 and Z-3) are employed as the component Z in the intermediate layer, and Component T and the vinyl type resin segment (Component Z-1) and the reactive organic silicon compounds (Components Z-2 and Z-3) as Component Z are contained in the protective layer display considerable improvement effects in each of the evaluated items compared with the other Photoreceptors 2-7 and 2-14. In contrast, the increasing in the remaining potential is large, the image density is lowered, the dielectric breakdown occurs and the sharpness is lowered in Photoreceptor 2-15 in which the intermediate layer contains the polyamide resin as the binder and no Component Z. Furthermore, the increasing in the remaining potential and the variation in the charged potential are large, the image density is lowered, the fog, dielectric breakdown and moire occur and lowering in the sharpness is resulted in Photoreceptor 2-16 in which no Component X is not employed in the intermediate layer.

Evaluation 2 (Evaluation Employing Magnet Brush)

<Evaluation Conditions>

Photoreceptors 2-1 through 2-14 were evaluated in the same manner as in Evaluation 1 except that the charging roller was replaced by a magnet brush and the line speed of the photoreceptor was changed to 140 mm/sec.

(Magnet Brush Charging Device)

A magnet brush having the structure displayed in FIG. 2 was employed.

Preparation of Magnetic Particles

A slurry was prepared by powdering and mixing 50 mole-% of $Fe_2O_3$, 24 mole-% of CuO and 24 or more mole-% of ZnO and adding a dispersing agent, binder and water. The slurry was subjected to granulation treatment classified and baked at 1125° C. Thus obtained magnetic particles were loosen and classified to obtain Magnetic Particle 1 having a volume average particle diameter of 27 μm. The specific resistance of the magnetic particle was $2\times10^7$ Ωcm and the magnetizing force was 65 emu/g.

Method for Measuring the Volume Average Diameter of the Magnetic Particle

The volume average particle diameter of the carrier was measured by a laser diffraction particle distribution measuring apparatus HELOS manufactured by Sympatec Co., Ltd, which has wet type dispersing device.

Method for Measuring the Specific Resistance (Ωcm)

The magnetic particles were put into a receptacle having a cross section area of 0.50 $cm^2$ and tapped, and a load of 1 $kg/cm^2$ was applied onto the stuffed magnetic particles. The specific resistance was obtained from the value of the electric current when voltage was applied so that an electric field of 1,000 V/cm between the loading electrode and an electrode provided at the bottom of the receptacle.

Charging Conditions

Charging sleeve: A sleeve made from stainless steel having a diameter of 10 mm

Voltage applied to the sleeve: Direct current voltage of 450 V overlapped with alternative current voltage.

Amount of magnetic particle in charging area: 250 $mg/cm^2$

Ratio of line speed of charging sleeve to photoreceptor: 0.8

<Evaluation>

In the image formation employing the contacting charging system using the magnetic brush, Photoreceptors 2-1 through 2-14 displayed almost the same effects as those in the case of the charging by the charging roller. In the foregoing Example 2, the photoreceptors could be provided, the photoreceptors exhibited the good results such as the increasing of the remaining potential under the low temperature and humidity and the high temperature and humidity condition and the variation of the charged potential were prevented which tended to occur in the contacting charging system capable of reducing the generating amount of ozone and nitrogen oxide compounds, the dielectric breakdown and the image defects were prevented and electrophotographic images satisfactory in the image density, fog, moire and sharpness were stably provided for a prolonged period.

Example 3

Preparation of Photoreceptor 3-1

Photoreceptor 3-1 was prepared in the same manner as in Photoreceptor 2-1 except that a charge injection layer having a 2 μm was provided by employing the following surface protective layer coating liquid in place of the protective layer.

| <Charge injection layer> | |
|---|---|
| Charge transfer material ([4-(2,2-diphenylvinyl)phenyl]-di-p-tolylamine) | 200 parts |
| Bisphenol Z type polycarbonate (Iupilon Z300, Mitsubishi Gas Kagaku Co., Ltd.) | 300 parts |
| Antimony-doped tin oxide ultra fine particle surface treated by the following compound A (treated amount of 7%) | 250 parts |
| Antimony doped tin oxide fine particle surface treated (treated amount of 20%) by methylhydrogensilicone oil (Commercial name: FK99, Shin'etsu Silicone Co., Ltd.) | 250 parts |
| Hindered amine, Sanol LS2626 (Mankyo Co., Ltd.) | 3 parts |
| Polytetrafluoroethylene resin particle (average diameter: 0.5 μm) | 150 parts |
| 1-butanol | 2000 parts |

The above-mentioned were dissolved to prepare a surface protective layer coating liquid. The coating liquid was coated on the charge transfer layer of Photoreceptor 3-1 by the immersion method and thermally hardened at 100° C. for 40 minutes to form a charge injection layer having a thickness of 2.0 μm. Thus Photoreceptor 3-1 was prepared. The contact angle of the surface of Photoreceptor 3-1 to water was 116°.

Preparation of Photoreceptor 3-2

Photoreceptor 3-2 having the intermediate layer containing the compound formed by the composition containing Components X, Y and Z was prepared in the same manner as in Photoreceptor 3-1 except that that the titanium oxide having a diameter of 35 nm was replaced by anatase type titanium oxide pigment having a diameter 15 nm.

Preparation of Photoreceptor 3-3

Photoreceptor 3-3 having the intermediate layer containing the compound formed by the composition containing Components X, Y and Z was prepared in the same manner as in Photoreceptor 3-1 except that the titanium oxide having a diameter of 35 nm was replaced by anatase type titanium oxide pigment having a diameter 180 nm.

Preparation of Photoreceptor 3-4

Photoreceptor 3-4 having the intermediate layer containing the compound formed by the composition containing Components X, Y and Z was prepared in the same manner as in Photoreceptor 3-1 except that the vinyl type resin segment A solution in the intermediate layer was replaced by the vinyl type resin segment B solution (the solution of silyl-modified vinyl type resin segment B having a hindered amine group).

Preparation of Photoreceptor 3-5

Photoreceptor 3-5 having the intermediate layer containing the compound formed by the composition containing Components X, Y and Z was prepared in the same manner as in Photoreceptor 3-1 except that the intermediate layer was replaced by the intermediate layer employed in Photoreceptor 2-5.

Preparation of Photoreceptor 3-6

Photoreceptor 3-6 having the intermediate layer containing the compound formed by the composition containing Components X, Y and Z was prepared in the same manner as in Photoreceptor 3-1 except that the intermediate layer was replaced by the intermediate layer employed in Photoreceptor 2-6.

Preparation of Photoreceptor 3-7

Photoreceptor 3-7 having the intermediate layer containing the compound formed by the composition containing Components X, Y and Z was prepared in the same manner as in Photoreceptor 3-1 except that the anatase type titanium oxide as Component X in the intermediate layer coating liquid was replaced by rutile type titanium oxide (number average primary particle diameter of 35 μm) and the vinyl Type Resin Segment A solution was replaced by the vinyl Type Resin Segment C solution (the solution of silyl-modified vinyl Type Resin Segment C).

Preparation of Photoreceptor 3-8

Photoreceptor 3-8 having the intermediate layer containing the compound formed by the composition containing Components X, Y and Z was prepared in the same manner as in Photoreceptor 3-1 except that the titanium oxide as Component X in the intermediate layer was replaced by zinc oxide (number average primary particle diameter of 100 nm).

Preparation of Photoreceptor 3-9

Photoreceptor 3-9 having the intermediate layer containing the compound formed by the composition containing Components X, Y and Z was prepared in the same manner as in Photoreceptor 3-1 except that the titanium oxide as Component X in the intermediate layer was replaced by zirconium oxide (number average primary particle diameter of 350 nm).

Preparation of Photoreceptor 3-10

Photoreceptor 3-10 having the intermediate layer containing the compound formed by the composition containing Components X, Y and Z was prepared in the same manner as in Photoreceptor 3-1 except that the titanium oxide as Component X in the intermediate was replaced by aluminum oxide $Al_2O_3$ (number average primary particle-diameter of 35 nm).

Preparation of Photoreceptor 3-11

Photoreceptor 3-11 having the intermediate layer containing the compound formed by the composition containing Components X, Y and Z (the intermediate layer coating liquid) was prepared in the same manner as in Photoreceptor 3-1 except that Z-1 in the intermediate layer coating liquid was omitted and the amount of Z-2 and Z-3 were each varied from 70 parts to 140 parts and from 30 parts to 60 parts, respectively.

Photoreceptors 3-12 through 3-15

Photoreceptors 3-12 through 3-15 were prepared in the same manner as in Photoreceptor 3-1 except that the kind and amount of the polytetrafluoroethylene resin and the layer thickness were varied as described in Table 6 so as to changed the contact angle of the photoreceptor.

Photoreceptor 3-16

Photoreceptor 3-16 was prepared in the same manner as in Photoreceptor 3-1 except that the intermediate layer was replaced by the intermediate layer formed in Photoreceptor 2-15.

Photoreceptor 3-17

Photoreceptor 3-16 was prepared in the same manner as in Photoreceptor 3-1 except that the titanium oxide of Component X in the intermediate layer coating liquid was omitted.

The difference points of the intermediate layers and the charge injection layers and the measurement results of the contact angle of the photoreceptor surface to water are listed in Table 6.

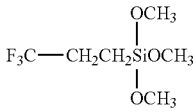

Compound A

TABLE 6

| Photoreceptor No. | Intermediate layer: Component X | Component Y | Component Z | Layer thickness (μm) | Charge injection layer: Fluorinated resin particle (Kind & amount (part)) | Layer thickness (μm) | Contact angle (Degree) |
|---|---|---|---|---|---|---|---|
| 3-1 | *1 | Isopropyltriisostearoyl titanate | Z-1: Vinyl type resin segment A<br>Z-2: Methyltrimethoxysilane<br>Z-3: Dimethyldimethoxysilane | 10 | G(150) | 2 | 116 |
| 3-2 | *2 | Isopropyltriisostearoyl titanate | Z-1: Vinyl type resin segment A<br>Z-2: Methyltrimethoxysilane<br>Z-3: Dimethyldimethoxysilane | 10 | G(150) | 2 | 116 |
| 3-3 | *3 | Isopropyltriisostearoyl titanate | Z-1: Vinyl type resin segment A<br>Z-2: Methyltrimethoxysilane<br>Z-3: Dimethyldimethoxysilane | 10 | G(150) | 2 | 116 |
| 3-4 | *1 | Isopropyltriisostearoyl titanate | Z-1: Vinyl type resin segment B<br>Z-2: Methyltrimethoxysilane<br>Z-3: Dimethyldimethoxysilane | 10 | G(150) | 2 | 116 |
| 3-5 | *1 | γ-glycidoxypropyltrimethoxysilane | Z-1: Vinyl type resin segment A<br>Z-2: Methyltrimethoxysilane | 4 | G(150) | 2 | 116 |
| 3-6 | *1 | γ-glycidoxypropyltrimethoxysilane | Z-1: Vinyl type resin segment B<br>Z-2: Methyltrimethoxysilane | 20 | G(150) | 2 | 116 |
| 3-7 | *4 | Isopropyltriisostearoyl titanate | Z-1: Vinyl type resin segment C<br>Z-2: Methyltrimethoxysilane<br>Z-3: Dimethyldimethoxysilane | 10 | G(150) | 2 | 116 |
| 3-8 | *5 | Isopropyltriisostearoyl titanate | Z-1: Vinyl type resin segment C<br>Z-2: Methyltrimethoxysilane<br>Z-3: Dimethyldimethoxysilane | 10 | G(150) | 2 | 116 |
| 3-9 | *6 | Isopropyltriisostearoyl titanate | Z-1: Vinyl type resin segment C<br>Z-2: Methyltrimethoxysilane<br>Z-3: Dimethyldimethoxysilane | 10 | G(150) | 2 | 116 |
| 3-10 | *7 | Isopropyltriisostearoyl titanate | Z-1: Vinyl type resin segment A<br>Z-2: Methyltrimethoxysilane<br>Z-3: Dimethyldimethoxysilane | 20 | G(150) | 2 | 116 |

*1: Anatase type titanium oxide: 35 nm

*2: Anatase type titanium oxide: 15 nm

*3: *1: Anatase type titanium oxide: 180 nm

*4: Rutile type titanium oxide: 35 nm

*5: Zinc oxide: 100 nm

*6: Zirconium oxide: 350 nm

*7: Aluminum oxide: 35 nm

TABLE 7

| Photoreceptor No. | Intermediate layer: Component X | Component Y | Component Z | Layer thickness (μm) | Charge injection layer: Fluorinated resin particle (Kind & amount (part)) | Layer thickness (μm) | Contact angle (Degree) |
|---|---|---|---|---|---|---|---|
| 3-11 | *1 | Isopropyltriisostearoyl titanate | Z-2: Methyltrimethoxysilane<br>Z-3: Dimethyldimethoxysilane | 10 | G(150) | 2 | 116 |
| 3-12 | *1 | Isopropyltriisostearoyl titanate | Z-1: Vinyl type resin segment A<br>Z-2: Methyltrimethoxysilane<br>Z-3: Dimethyldimethoxysilane | 10 | G(200) | 1 | 121 |
| 3-13 | *1 | Isopropyltriisostearoyl titanate | Z-1: Vinyl type resin segment A<br>Z-2: Methyltrimethoxysilane<br>Z-3: Dimethyldimethoxysilane | 10 | H(100) | 5 | 96 |
| 3-14 | *1 | Isopropyltriisostearoyl titanate | Z-1: Vinyl type resin segment A<br>Z-2: Methyltrimethoxysilane<br>Z-3: Dimethyldimethoxysilane | 10 | H(70) | 2 | 93 |
| 3-15 | *1 | Isopropyltriisostearoyl titanate | Z-1: Vinyl type resin segment A<br>Z-2: Methyltrimethoxysilane<br>Z-3: Dimethyldimethoxysilane | 10 | — | 2 | 86 |
| 3-16 | *1 | Isopropyltriisostearoyl titanate | Polyamide | 10 | G(150) | 2 | 116 |
| 3-17 | — | Isopropyltriisostearoyl titanate | Z-1: Vinyl type resin segment A<br>Z-2: Methyltrimethoxysilane<br>Z-3: Dimethyldimethoxysilane | 10 | G(150) | 2 | 116 |

*1: Anatase type titanium oxide: 35 nm

G and H are the following fluorinated resin fine particles. G: Ethylene tetrafluoride resin particle, RUBLON L-2, manufactured by Daikin Kogyo Co., Ltd. H: Ethylene trifluoride resin particle, DAIFULON, manufactured by Daikin Kogyo Co., Ltd.

Samples for volume resistance measurement were prepared in the same time of the preparation of the photoreceptors 3-1 through 3-17 by coating each of the intermediate layer coating liquids on a poly(ethylene terephthalate) support on which an aluminum layer was deposited by evaporation and dried under a condition the same as that in the photoreceptor 1 to form a layer having a thickness of 10 μm. After that the volume resistance of each of the samples was measures. The volume resistance of the intermediate layers of Photoreceptors 3-1 through 3-17 were all not less than $1\times10^8$. The solubility in the solvent of the coating liquid of each of the intermediate layer was inspected at the same time. As a result of that, it was observed that all the intermediate layers except the intermediate layer of Photoreceptor 16 were not dissolved in the coating liquid solvent, and was confirmed that these intermediate layers had three dimensional crosslinked structure. In contrast, the intermediate layer of Photoreceptor 16 showed solubility to the coating liquid solvent and the form of the intermediate layer was gradually dissolved.

Evaluation 1 (Evaluation Employing the Charging Roller)

The evaluation was performed as the same as in Example 2.

TABLE 8

| Photoreceptor No. | Potential evaluation (Remaining potential) LL | HH | Potential evaluation (Charged potential) LL | HH | Image evaluation: Image density | Fog | Dielectric breakdown | Black spot | Moire | Sharpness |
|---|---|---|---|---|---|---|---|---|---|---|
| 3-1 | ◎ | ◎ | ◎ | ◎ | ◎ | ◎ | ○ | ◎ | ◎ | ◎ |
| 3-2 | ◎ | ◎ | ◎ | ◎ | ◎ | ◎ | ○ | ◎ | ◎ | ◎ |
| 3-3 | ◎ | ◎ | ◎ | ◎ | ◎ | ◎ | ○ | ◎ | ◎ | ◎ |
| 3-4 | ◎ | ◎ | ◎ | ◎ | ◎ | ◎ | ○ | ◎ | ◎ | ◎ |
| 3-5 | ◎ | ◎ | ◎ | ◎ | ◎ | ◎ | ○ | ◎ | ◎ | ◎ |
| 3-6 | ◎ | ◎ | ◎ | ◎ | ◎ | ◎ | ○ | ◎ | ◎ | ◎ |
| 3-7 | ○ | ◎ | ◎ | ◎ | ○ | ◎ | ○ | ○ | ◎ | ○ |
| 3-8 | ○ | ○ | ○ | ○ | ○ | ○ | ○ | ○ | ◎ | ◎ |
| 3-9 | ○ | ○ | ○ | ○ | ○ | ○ | ○ | ○ | ◎ | ◎ |
| 3-10 | ○ | ◎ | ◎ | ◎ | ○ | ◎ | ○ | ◎ | ◎ | ◎ |
| 3-11 | ○ | ○ | ◎ | ○ | ○ | ○ | ○ | ◎ | ◎ | ○ |
| 3-12 | ◎ | ◎ | ◎ | ◎ | ◎ | ◎ | ○ | ◎ | ◎ | ◎ |
| 3-13 | ◎ | ◎ | ◎ | ◎ | ◎ | ◎ | ○ | ◎ | ◎ | ◎ |

TABLE 8-continued

| Photoreceptor No. | Potential evaluation (Remaining potential) LL | HH | Potential evaluation (Charged potential) LL | HH | Image evaluation: Image density | Fog | Dielectric breakdown | Black spot | Moire | Sharpness |
|---|---|---|---|---|---|---|---|---|---|---|
| 3-14 | ○ | ◎ | ◎ | ○ | ○ | ○ | ○ | ◎ | ◎ | ○ |
| 3-15 | ○ | ○ | ◎ | ○ | ○ | ○ | ○ | ◎ | ◎ | ○ |
| 3-16 | X | X | ○ | ○ | X | ○ | X | ○ | ○ | X |
| 3-17 | X | ○ | ○ | X | X | X | X | ○ | X | X |

It is understood from Table 8 that Photoreceptors 3-1 through 3-15 the intermediate layer containing the compound formed from the composition containing Component X, Y and Z, the photosensitive layer provided on the intermediate layer and the charge injection layer are excellent in the stability of the remaining potential and the charged potential under the high temperature and humidity condition and the low temperature and humidity condition, and the sufficient image density and the lowered fog are resulted. Furthermore, no dielectric breakdown occurs and the improvement effect in the black spot occurrence is considerable. Thus the electrophotographic image having high sharpness can be obtained. Particularly, the improving effects in Photoreceptors 3-1 through 3-6 3-12 and 3-13 in which the anatase type titanium oxide as Component X, and the vinyl type resin segment (Component Z-1) and the reactive organic silicon compound (Components Z-2 and Z-3) are employed and the contact angel of the charge injection layer is not less than 95° C., are considerable compared with those in the other Photoreceptors 3-7 through 3-11, 3-14 and 3-15. In contrast, the increasing of remaining potential is large, the image density is lowered, the dielectric breakdown occurs and the sharpness is degraded in Photoreceptor 3-16 in which the polyamide resin as the binder and no Component Z are employed in the intermediate layer. Moreover, in Photoreceptor 3-17 in which Component X is not employed in the intermediate layer, the increasing of the remaining potential and the variation in the charged potential are large, and the lowering in the image density, fog, dielectric breakdown and moire occur and the degradation of the sharpness is resulted. Evaluation 2 (Evaluation employing the magnetic brush)

<Evaluation Condition>

Photoreceptors 3-1 through 3-15 were evaluated in the same manner the same as in Example 2. The effects almost the same as those in the case of the contact charging by the charging roller were obtained regarding Photoreceptors 3-1 through 3-15 even by the image forming method by the contact charging system employing the magnetic brush.

In Example 3, the photoreceptors to be used for the contacting charging system was obtained which had stable properties for a prolonged period in which the occurrence of the image defect such as the dielectric breakdown and the black spots and the spreading of image were prevented and the degradation of the electrophotographic properties such as the sensitivity and the remaining potential which tended to be caused by the repeating use was also prevented by providing the intermediate layer on the electroconductive substrate by which the charge leak could be prevented and the charging properties in the course of the repeating use could be stabilized, and by providing the protective layer on the photosensitive layer in which cracks and stains caused by scrubbing by the contacting charging member difficulty occurred. By the use of such the photoreceptors, clear electrophotographic images having high image density and high resolution could be stably obtained.

What is claimed is:

1. An electrophotographic photoreceptor having a photosensitive layer and an intermediate layer on an electroconductive substrate in which the intermediate layer contains a compound formed from a composition containing an inorganic oxide network forming compound Component X that is surface-treated by a metal atom-containing organic network forming component Component Y, and a binder network forming compound Component Z wherein the Component X comprises an inorganic oxide particle having a reactive group on the surface thereof, the inorganic oxide particle comprises at least one of $TiO_2$, $ZrO_2$, ZnO or $Al_2O_3$, and the Component Z is a reactive organic silicon compound.

2. The electrophotographic photoreceptor of claim 1, wherein the $TiO_2$ is anatase type titanium oxide.

3. The electrophotographic photoreceptor of claim 1, wherein the number average primary particle diameter of the inorganic oxide particle is from 5 to 400 nm.

4. The electrophotographic photoreceptor of claim 1, wherein the Component Y is a coupling agent.

5. The electrophotographic photoreceptor of claim 4, wherein the coupling agent is a titanium coupling agent or a silane coupling agent.

6. The electrophotographic photoreceptor of claim 1, wherein the thickness of the intermediate layer is from 0.2 to 20 μm.

7. The electrophotographic photoreceptor of claim 1, wherein the photoreceptor further has a protective layer and the protective layer contains a compound formed from a composition containing the Component Z and a Component T of a charge transfer subunit forming compound.

8. The electrophotographic photoreceptor of claim 1, wherein the photoreceptor has a charge injection layer.

9. The electrophotographic photoreceptor of claim 8, wherein the charge injection layer contains a electroconductive particle.

10. The electrophotographic photoreceptor of claim 9, wherein the volume resistance of the charge injection layer is from $10^{10}$ to $10^{15}$ Ω·cm.

11. An image forming apparatus having the photoreceptor described in claim 1.

12. The image forming apparatus of claim 11, further comprising a charging device to charge by contacting a charging member to the electrophotographic photoreceptor.

13. The image forming apparatus of claim 12, further comprising a developing device to visualize a static latent image formed on the electrophotographic photoreceptor, and a transfer device to transfer the visualized toner image to an image receiving material.

14. An image forming method comprising charging the electrophotographic photoreceptor described in claim 1 by contacting to a charging member, imagewise exposing the charged photoreceptor to form a static latent image; and developing the static latent image with a developer comprising a toner to form a toner image.

15. An electrophotographic photoreceptor having a photosensitive layer and an intermediate layer on an electroconductive substrate in which the intermediate layer contains a compound formed from a composition containing an inorganic oxide network forming compound Component X that is surface-treated by a metal atom-containing organic network forming component Component Y, and a binder network forming compound Component Z wherein the Component X comprises an inorganic oxide particle having a reactive group on the surface thereof, the inorganic oxide particle comprises at least one of $TiO_2$, $ZrO_2$, ZnO or $Al_2O_3$, and the Component Z is a combination of a reactive organic silicon compound and a reactive segment.

16. The electrophotographic photoreceptor of claim 15, wherein the reactive segment is a low polymerization degree vinyl resin.

* * * * *